US007845321B2

(12) United States Patent
Kobaishi

(10) Patent No.: US 7,845,321 B2
(45) **Date of Patent: *Dec. 7, 2010**

(54) CONTROLLER FOR VANE-TYPE VARIABLE TIMING ADJUSTING MECHANISM

(75) Inventor: Tokuyasu Kobaishi, Toyoake (JP)

(73) Assignee: Denso Corporation, Kariya, Aichi-Pref. (JP)

( * ) Notice: Subject to any disclaimer, the term of this patent is extended or adjusted under 35 U.S.C. 154(b) by 365 days.

This patent is subject to a terminal disclaimer.

(21) Appl. No.: 12/065,366

(22) PCT Filed: Apr. 23, 2007

(86) PCT No.: PCT/JP2007/058695

§ 371 (c)(1),
(2), (4) Date: Feb. 29, 2008

(87) PCT Pub. No.: WO2007/125842

PCT Pub. Date: Nov. 8, 2007

(65) Prior Publication Data

US 2009/0151671 A1 Jun. 18, 2009

(30) Foreign Application Priority Data

Apr. 26, 2006 (JP) ..... 2006-121419

(51) Int. Cl.
*F01L 1/34* (2006.01)

(52) U.S. Cl. ..... 123/90.17; 123/90.15; 123/90.12; 464/160

(58) Field of Classification Search ..... 123/90.12, 123/90.13, 90.15, 90.16, 90.17, 90.18; 464/1, 464/2, 160

See application file for complete search history.

(56) References Cited

U.S. PATENT DOCUMENTS 5,218,935 A 6/1993 Quinn, Jr. et al.
5,497,738 A 3/1996 Siemon et al.

(Continued)

FOREIGN PATENT DOCUMENTS

JP 2005-009393 1/2005

OTHER PUBLICATIONS

International Search Report for PCT/JP2007/058695 dated Jul. 24, 2007.

*Primary Examiner*—Ching Chang
(74) *Attorney, Agent, or Firm*—Nixon & Vanderhye PC

(57) ABSTRACT

One-way valves (30, 31) are provided in a hydraulic supply passage (28) in an advance chamber (18) and a hydraulic supply passage (29) in a retard chamber (19) respectively for preventing reverse flow of oil from each chamber (18, 19) and drain oil passages (32, 33) bypassing the one-way valves respectively disposed in the hydraulic supply passages (28, 29) of the respective hydraulic chambers (18, 19) are provided to be in parallel therewith. Drain switching valves (34, 35) are disposed in the respective drain oil passages (32, 33). A hydraulic control valve (21) for controlling a hydraulic pressure supplied to the advance chamber (18) and the retard chamber (19) includes integrally a drain switching control function (38) for controlling a hydraulic pressure supplied to the respective drain switching valves (34, 35). A point where a VCT response speed rapidly changes by switching opening/closing of the drain switching valves (34, 35) is learned to improve a control characteristic in the vicinity of the rapidly changing point of the VCT response speed.

29 Claims, 22 Drawing Sheets

U.S. PATENT DOCUMENTS 6,330,870 B1 12/2001 Inoue et al.
6,513,468 B2 2/2003 Takahashi et al.
6,763,791 B2 7/2004 Gardner et al.
7,434,554 B2 * 10/2008 Nagashima ..... 123/90.17

* cited by examiner

FIG. 11

| ENGINE ROTATIONAL SPEED (rpm) | LOAD (INTAKE PRESSURE: kPa) | | | | | | | |
|---|---|---|---|---|---|---|---|---|
| | 30 | 40 | 50 | 60 | 70 | 80 | 90 | 100 |
| 600 | 0 | 0 | 0 | 0 | 0 | 10 | 10 | 10 |
| 800 | 0 | 0 | 0 | 0 | 0 | 10 | 10 | 20 |
| 1000 | 0 | 10 | 20 | 20 | 20 | 20 | 20 | 20 |
| 1200 | 0 | 30 | 30 | 30 | 30 | 20 | 20 | 20 |
| 1400 | 0 | 30 | 30 | 40 | 40 | 40 | 30 | 20 |
| 1600 | 0 | 30 | 40 | 40 | 40 | 40 | 30 | 20 |
| 1800 | 0 | 30 | 40 | 40 | 40 | 40 | 30 | 20 |
| 2000 | 0 | 30 | 40 | 40 | 40 | 40 | 30 | 20 |
| 2400 | 0 | 30 | 40 | 40 | 40 | 40 | 30 | 20 |
| 2800 | 0 | 30 | 40 | 40 | 40 | 40 | 30 | 20 |
| 3200 | 0 | 30 | 40 | 40 | 40 | 40 | 30 | 20 |
| 3600 | 0 | 20 | 40 | 40 | 40 | 40 | 30 | 20 |
| 3800 | 0 | 20 | 40 | 40 | 40 | 40 | 20 | 20 |
| 4000 | 0 | 20 | 40 | 40 | 40 | 40 | 20 | 20 |
| 4400 | 0 | 20 | 30 | 30 | 30 | 30 | 20 | 20 |
| 4800 | 0 | 20 | 30 | 30 | 20 | 20 | 10 | 10 |
| 5200 | 0 | 10 | 20 | 20 | 20 | 10 | 10 | 10 |
| 5600 | 0 | 10 | 10 | 10 | 10 | 10 | 10 | 10 |
| 6000 | 0 | 0 | 0 | 0 | 0 | 0 | 0 | 0 |

: LEARN VCT RESPONSE CHARACTERISTIC IN REGION WHERE ADVANCE AMOUNT IS LARGE

CONTROLLER FOR VANE-TYPE VARIABLE TIMING ADJUSTING MECHANISM

CROSS REFERENCE TO RELATED APPLICATION

This application is the U.S. national phase of International Applicatio No. PCT/JP2007/058695 filed 23 Apr. 2007 which designated the U.S. and claims priority to Japanese Patent Application No. 2006-121419 filed on Apr. 26, 2006, the disclosure of each of which is incorporated herein by reference.

FIELD OF THE INVENTION

The present invention relates to a controller for a vane-type variable valve timing adjusting mechanism in which one-way valves are disposed in a hydraulic supply passage of an advance hydraulic chamber and in a hydraulic supply passage of a retard hydraulic chamber respectively for preventing reverse flow of operating oil from the respective hydraulic chambers.

BACKGROUND OF THE INVENTION

A vane-type variable valve timing adjusting mechanism is, as shown in JP2001-159330A (U.S. Pat. No. 6,330,870B1), adapted in such a manner that a housing rotating in a timed relation to a crank shaft of an engine is disposed coaxially with a vane rotor connected to a cam shaft of an intake valve (or exhaust valve) and a plurality of vane-accommodating chambers formed in the housing respectively are divided into an advance hydraulic chamber and a retard hydraulic chamber by vanes (blade portions) at the outer periphery of the vane rotor. In addition, the hydraulic pressure in each hydraulic chamber is designed to be controlled by a hydraulic control valve to rotate the vane rotor relative to the housing, so that a displacement angle of the camshaft (cam shaft phase) to the crankshaft is varied to variably control valve timing.

In such vane-type variable valve timing adjusting mechanism, at the time of opening/closing the intake valve or the exhaust valve during engine operating, fluctuations of torque which the camshaft receives from the intake valve or the exhaust valve are transmitted to the vane rotor. In consequence, torque fluctuations in the retard direction or in the advance direction are exerted on the vane rotor. Thereby, when the vane rotor is subjected to torque fluctuations in the retard direction, the operating oil in the advance hydraulic chamber is to be subjected to such pressure as to be pushed out of the advance hydraulic chamber or when the vane rotor is subjected to torque fluctuations in the advance direction, the operating oil in the retard hydraulic chamber is to be subjected to such pressure as to be pushed out of the retard hydraulic chamber. In consequence, in a low-rotation region where pressures supplied from a hydraulic supply source are low, even when a displacement angle of the cam shaft is designed to be advanced by supplying the hydraulic pressure to the advance hydraulic chamber, the vane rotor is, as shown in a dotted line of FIG. 3, pushed back in the retard direction due to the torque fluctuations. As a result, the response time to a target displacement angle of the vane rotor is longer.

In order to solve this problem, as shown in JP2003-106115A (U.S. Pat. No. 6,763,791 B2), a one-way valve is disposed in each of a hydraulic supply passage of an advance hydraulic chamber and a hydraulic supply passage of a retard hydraulic chamber for preventing reverse flow of operating oil from the advance hydraulic chamber or the retard hydraulic chamber. Thereby, as shown in a solid line of FIG. 3, it is considered that this one-way valve is adapted to prevent the vane rotor from being pushed back in the reverse direction to the direction of a target displacement angle during variable valve timing controlling, improving response characteristic of the variable valve timing control.

In the variable valve timing adjusting mechanism, the one-way valve is disposed in each of the hydraulic supply passage of the advance hydraulic chamber and the hydraulic supply passage of the retard hydraulic chamber (hydraulic introduction line) and also a returning line (hydraulic discharge line) is disposed in parallel to the hydraulic supply passage of each hydraulic chamber for bypassing the one-way valve. As a result, this controller provides a structure where a function as a line switching valve for opening/closing the returning line of each hydraulic chamber is united to a hydraulic control valve (spool valve) controlling the hydraulic pressure supplied to each hydraulic chamber. Further, a control current value of the hydraulic control valve is controlled to control the hydraulic pressure supplied to each hydraulic chamber and at the same time, to control the switching in opening/closing of the returning line of each hydraulic chamber. Hereby, when the hydraulic pressure in each hydraulic chamber is required to be released, this controller is adapted to quickly release the hydraulic pressure through the returning line by opening the returning line of the corresponding hydraulic chamber.

Since an operating characteristic of the variable valve timing adjusting mechanism or the hydraulic control valve, however, has manufacturing variations, it is difficult to accurately perform both of the hydraulic control of each hydraulic chamber and the switching control of the returning line simultaneously by using one hydraulic control valve to which a function of the line switching valve is united. In addition, it is unavoidable that variations in a response characteristic of the vane rotor (relation between a control current value of the hydraulic control valve and a response speed of the vane rotor) occur. The variations of this response characteristic are the cause of reducing the effect (effect of an improvement in a response characteristic of an advance operation in a low hydraulic region) obtained by the one-way valve.

DISCLOSURE OF THE INVENTION

The present invention is made in view of the foregoing problems and an object of the present invention is to provide a controller for a vane-type variable valve timing adjusting mechanism which can perform a variable valve timing control (control for a control current value of a hydraulic control valve) in consideration of manufacturing variations of the variable valve timing adjusting mechanism or the hydraulic control valve.

In order to achieve the above object, according to an aspect of the present invention, each of a plurality of vane accommodating chambers formed in a housing of a vane-type variable valve timing adjusting mechanism is divided into an advance hydraulic chamber and a retard hydraulic chamber by a vane. There is provided a one-way valve disposed in each of a hydraulic supply passage of the advance hydraulic chamber and a hydraulic supply passage of the retard hydraulic chamber in at least one of the vane accommodating chambers for preventing reverse flow of operating oil from the each hydraulic chamber A drain oil passage is disposed in parallel to the hydraulic supply passage of the each hydraulic chamber for bypassing the one-way valve and a hydraulic control valve for controlling a hydraulic pressure supplied to the each hydraulic chamber has a drain switching control function for opening/closing the drain oil passage of the each hydraulic chamber. Further, there is provided response characteristic learning means for learning a response characteristic of the variable valve timing adjusting mechanism to a control current value of the hydraulic control valve. In this way, the response characteristic of the variable valve timing adjusting mechanism to the control current value of the hydraulic control valve during engine operating can be learned and therefore, use of the learning value allows realization of a variable valve timing control (control for the control current value of the hydraulic control valve) in consideration of manufacturing variations of the variable valve timing adjusting mechanism or the hydraulic control valve.

BRIEF DESCRIPTION OF THE DRAWINGS

FIG. 11 is a diagram showing one example of a map of a target displacement angle at a normal control time.

BEST MODE OF CARRYING OUT THE INVENTION

Figure 1:
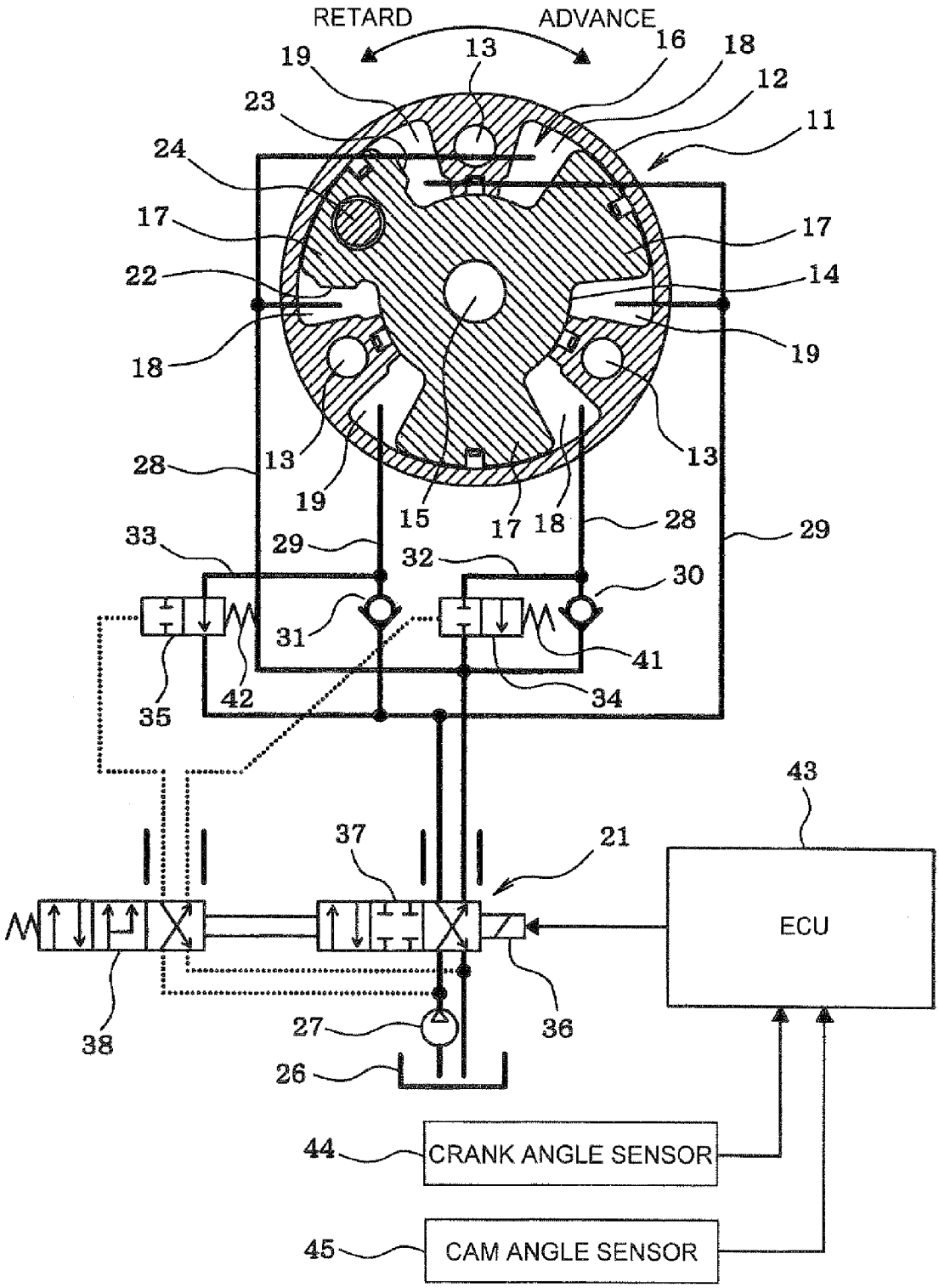
FIG. 1 is a schematic diagram showing a variable valve timing adjusting mechanism and a hydraulic control circuit thereof in an embodiment of the present invention.

Hereinafter, embodiments for a best mode of carrying out the present invention will be described.

First, a structure of a vane-type variable valve timing adjusting mechanism 11 will be explained with reference to FIG. 1. A housing 12 of the variable valve timing adjusting mechanism 11 is clamped and fixed to a sprocket rotatably supported at an outer periphery of a cam shaft in an intake side or an exhaust side (not shown) by bolts 13. In consequence, rotation of a crank shaft for an engine is transmitted through a timing chain to the sprocket and the housing 12, and the sprocket and the housing 12 rotate in a timed relation to the crank shaft. A vane rotor 14 is accommodated inside the housing 12 so as to rotate relative thereto and is clamped and fixed to one end of the cam shaft by a bolt 15.

A plurality of vane accommodating chambers 16 for accommodating a plurality of vanes 17 at an outer periphery of the vane rotor 14 so as to rotate in the advance direction or the retard direction relative to the housing 12 are defined inside the housing 12 and each vane accommodating chamber 16 is divided into an advance hydraulic chamber (hereinafter, referred to as "advance chamber") 18 and a retard hydraulic chamber (hereinafter, referred to as "retard chamber") 19.

At a state where a hydraulic pressure beyond a predetermined pressure is supplied to the advance chamber 18 and the retard chamber 19, the vane 17 is held by the hydraulic pressures in the advance chamber 18 and the retard chamber 19 to transmit rotation of the housing 12 caused by rotation of the crank shaft to the vane rotor 14 through the hydraulic pressures, thereby rotating the cam shaft integrally with the vane rotor 14. During engine operating, the hydraulic pressures in the advance chamber 18 and the retard chamber 19 are controlled by a hydraulic control valve 21 to rotate the vane rotor 14 relative to the housing 12, thereby controlling a displacement angle of the cam shaft (cam shaft phase) to the crank shaft to vary valve timing of an intake valve (or exhaust valve).

In addition, stoppers 22 and 23 for controlling a relative rotational range of the vane rotor 14 to the housing 12 are formed at both side portions of either one of the vanes 17, and the maximum retard position and the maximum advance position of the displacement angle of the cam shaft (cam shaft phase) are restricted by the stoppers 22 and 23. In addition, either one of the vanes 17 is provided with a lock pin 24 disposed therein for locking a displacement angle of the cam shaft at a certain lock position at engine stopping or the like. This lock pin 24 is inserted into a lock hole (not shown) disposed in the housing 12, causing the displacement angle of the cam shaft to be locked at a certain lock position. This lock position is set to a position suitable for engine startup (for example, substantially intermediate position within an adjustment possible range of a displacement angle of the cam shaft).

Oil inside an oil pan 26 (operating oil) is supplied to a hydraulic control circuit of the variable valve timing adjusting mechanism 11 through the hydraulic control valve 21 by an oil pump 27. The hydraulic control circuit includes a hydraulic supply oil passage 28 supplying oil discharged from an advance pressure port of the hydraulic control valve 21 to a plurality of advance chambers 18 and a hydraulic supply oil passage 29 supplying oil discharged from a retard pressure port of the hydraulic control valve 21 to a plurality of retard chambers 19.

Further, one-way valves 30 and 31 are disposed in the hydraulic supply oil passage 28 of the advance chamber 18 and the hydraulic supply oil passage 29 of the retard chamber 19 for preventing reverse flow of the operating oil from the respective chambers 18 and 19. In the present embodiment, the one-way valves 30 and 31 are disposed in the hydraulic control oil passages 28 and 29 of the advance chamber 18 and the retard chamber 19 in the single vane accommodating chamber 16 only. The one-way valves 30 and 31 may be disposed in the hydraulic control oil passages 28 and 29 of the advance chamber 18 and the retard chamber 19 in each of a plurality of the vane accommodating chambers 16.

Drain oil passage 32 and 33 for bypassing the one-way valves 30 and 31 respectively are disposed in parallel in the hydraulic supply oil passages 28 and 29 of the respective chambers 18 and 19, and drain switching valves 34 and 35 are disposed in the drain oil passages 32 and 33 respectively. The drain switching valves 34 and 35 respectively are formed of spool valves driven in a closing direction by hydraulic pressure (pilot pressure) supplied from the hydraulic control valve 21. When the hydraulic pressure is not applied, the drain switching valves 34 and 35 are held in an opening position. When the drain switching valves 34 and 35 are opened, the drain oil passages 32 and 33 are opened, causing functions of the one-way valves 30 and 31 to be stopped. When the drain switching valves 34 and 35 are closed, the drain oil passages 32 and 33 are closed, causing functions of the one-way valves 30 and 31 to be effectively performed. Therefore, the reverse flow of the oil from the hydraulic chambers 18 and 19 is prevented, maintaining the hydraulic pressures in the hydraulic chambers 18 and 19.

The drain switching valves 34 and 35 respectively do not require electrical wiring, and are downsized to be incorporated in the vane rotor 14 inside the variable valve timing adjusting mechanism 11, together with the one-way valves 30 and 31. In consequence, the drain switching valves 34 and 35 are located near the hydraulic chambers 18 and 19 respectively and are adapted to open/close the respective drain oil passages 32 and 33 near the respective hydraulic chambers 18 and 19 at advance/retard operating in good response.

On the other hand, the hydraulic control valve 21 is formed of a spool valve driven by a linear solenoid 36, where an advance/retard hydraulic control valve 37 controlling the hydraulic pressures supplied to the advance chamber 18 and the retard chamber 19 is integral with the a drain switching control valve 38 switching the hydraulic pressure driving the drain switching valves 34 and 35 respectively. A current value (control duty) supplied to the linear solenoid 36 of the hydraulic control valve 21 is controlled by an engine control circuit (hereinafter referred to as "ECU") 43.

The ECU 43 calculates actual valve timing (actual displacement angle) of the intake valve (exhaust valve) based upon output signals of a crank angle sensor 44 and a cam angle sensor 45 and also calculates target valve timing (target displacement angle) of the intake valve (exhaust valve) based upon outputs of various sensors such as an intake pressure sensor and a water temperature sensor for detecting an engine operating condition. In addition, the ECU 43 feedback-controls (or feedforward-controls) a control current value of the hydraulic control valve 21 in the variable valve timing adjusting mechanism 11 so that the actual valve timing is equal to the target valve timing. Thereby, the hydraulic pressures in the advance chamber 18 and the retard chamber 19 are controlled to rotate the vane rotor 14 relative to the housing 12, causing a displacement angle of the cam shaft to be varied for making the actual valve timing be equal to the target valve timing.

Figure 3:
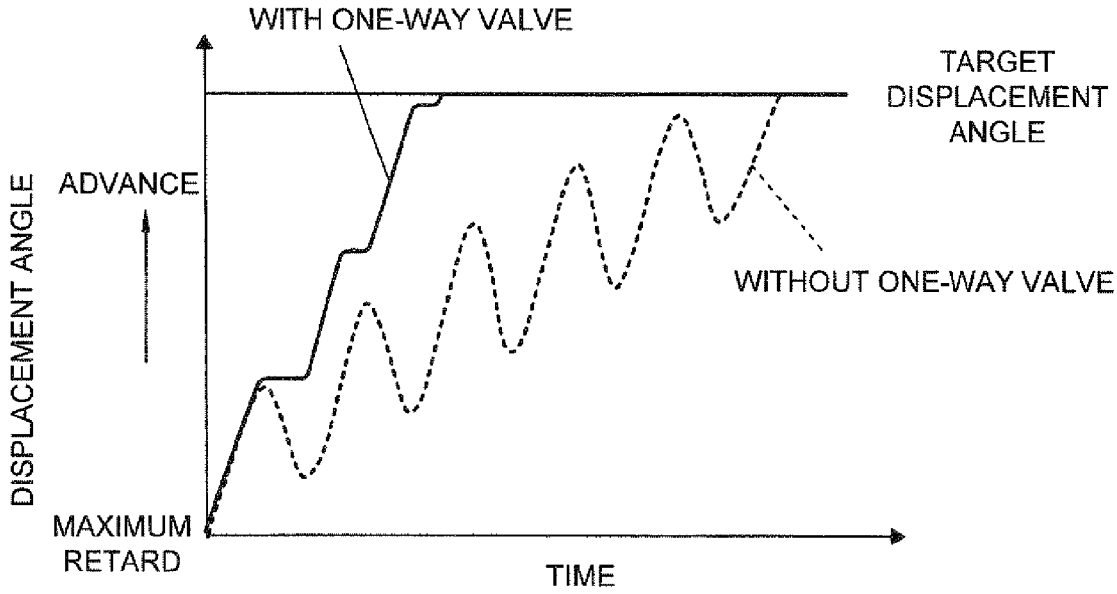
FIG. 3 is a characteristic diagram explaining a difference in VCT (variable valve timing adjusting mechanism) response speed at advance operating depending on presence/absence of a one-way valve.

Here, when the intake valve or the exhaust valve is opened/closed during engine operating, the torque fluctuation the cam shaft receives from the intake valve or the exhaust valve is transmitted to the vane rotor 14, causing the torque fluctuation in the retard direction and in the advance direction to be exerted on the vane rotor 14. In consequence, when the vane rotor 14 is subjected to the torque fluctuation in the retard direction, the operating oil in the advance chamber 18 receives the pressure to be pushed out of the advance chamber 18 and on the other hand, when the vane rotor 14 is subjected to the torque fluctuation in the advance directions the operating oil in the retard chamber 19 receives the pressure to be pushed out of the retard chamber 19. Therefore, in a low-rotation region where a discharge hydraulic pressure of the oil pump 27 as a hydraulic supply source is low, without the one-way valves 30 and 31 even if the hydraulic pressure is designed to be supplied to the advance chamber 18 to advance a displacement angle of the cam shaft, as shown in a dotted line of FIG. 3, the vane rotor 14 is pushed back in the retard direction due to the torque fluctuation, raising the problem that the response time until the vane rotor 14 reaches a target displacement angle is longer.

On the other hand, in the present embodiment, the one-way valves 30 and 31 are disposed in the hydraulic supply oil passage 28 of the advance chamber 18 and the hydraulic supply oil passage 29 of the retard chamber 19 for preventing reverse flow of the operating oil from the respective chambers 18 and 19. Further, the drain oil passage 32 and 33 for bypassing the one-way valves 30 and 31 respectively are disposed in parallel in the hydraulic supply oil passages 28 and 29 of the respective chambers 18 and 19, and drain switching valves 34 and 35 are disposed in the drain oil passages 32 and 33 respectively. As a result, as shown in FIG. 2(*a*), (b) and (c), the hydraulic pressures in the chambers 18 and 19 respectively are controlled in response to a retard operation, a holding operation and an advance operation as follows.

[Retard Operation]

Figure 2:
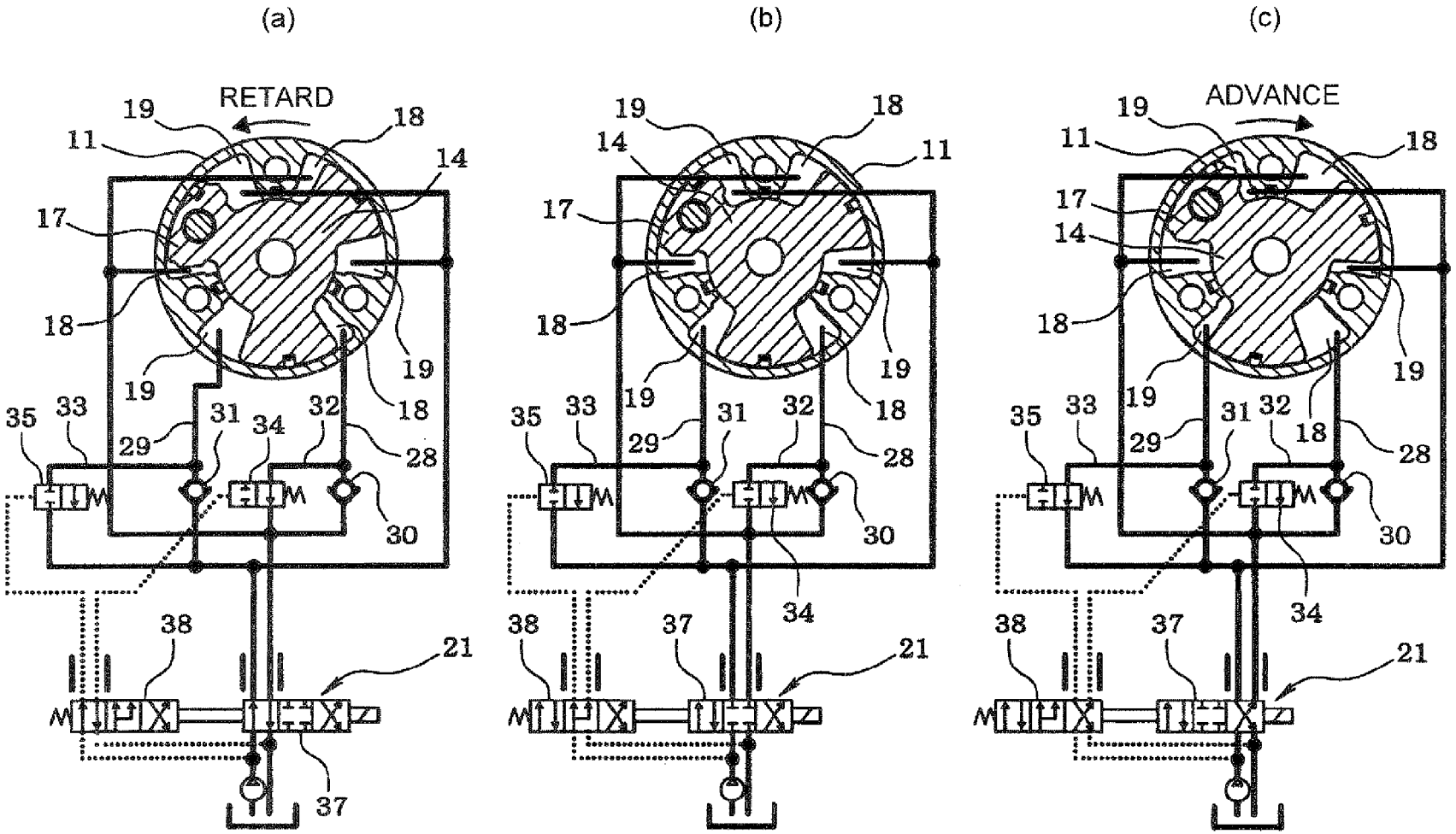
FIG. 2 is diagrams each explaining a retard operation, a holding operation and an advance operation in the variable valve timing adjusting mechanism.

As shown in FIG. 2(*a*), during retard operating where the actual valve timing is relatively quickly retarded toward the target valve timing in the retard side, the hydraulic pressure is added to the drain switching valve 34 in the advance chamber 18 from the hydraulic control valve 21 to open the drain switching valve 34 in the advance chamber 18, creating the state where the one-way valve 30 in the advance chamber 18 does not function. Further, the hydraulic supply to the drain switching valve 35 in the retard chamber 19 is stopped to close the drain switching valve 35 in the retard chamber 19, creating the state where the one-way valve 31 in the retard chamber 19 functions. In consequence, even at a low hydraulic pressure, upon occurrence of the torque fluctuation in the advance direction of the vane rotor 14, the reverse flow of oil from the retard chamber 19 is prevented with the one-way valve 31, while efficiently supplying the hydraulic pressure to the retard chamber 19, thereby improving the retard response characteristic.

[Intermediate Holding]

As shown in FIG. 2(*b*), during intermediate holding of holding the actual valve timing to the target valve timing, the hydraulic supply to both of the drain switching valves 34 and 35 in the advance chamber 18 and in the retard chamber 19 is stopped to close the drain switching valves 34 and 35, creating the state where the one-way valves 30 and 31 in the advance chamber 18 and in the retard chamber 19 function. In this state, even if the torque fluctuations in the retard direction and in the advance direction are applied to the vane rotor 14 due to the torque fluctuations which the cam shaft receives from the intake valve or the exhaust valve, the reverse flow of oil from both of the advance chamber 18 and the retard chamber 19 is prevented with the one-way valve 31 to prevent reduction in the hydraulic pressures holding the vane 17 from both side thereof thereby improving the holding stability. It should be noted that in a case of performing a relatively gentle advance/retard operation, for improving the holding stability, the drain switching valves 34 and 35 in both of the advance chamber 18 and the retard chamber 19 are closed. As a result, the one-way valves 30 and 31 in both of the advance chamber 18 and the retard chamber 19 are made to be in an activating state.

[Advance Operation]

As shown in FIG. 2(*c*), during advance operating where the actual valve timing is relatively quickly advanced toward the target valve timing in the advance side, the hydraulic pressure supply to the drain switching valve 34 in the advance chamber 18 is stopped to close the drain switching valve 34 in the advance chamber 18, causing the state where the one-way valve 30 in the advance chamber 18 functions. Further, the hydraulic pressure from the hydraulic control valve 21 is applied to the drain switching valve 35 in the retard chamber 19 is applied to open the drain switching valve 35 in the retard chamber 19, creating the state where the one-way valve 31 in the retard chamber 19 does not function. In consequence, even at a low hydraulic pressure, the reverse flow of oil from the advance chamber 18 upon occurrence of the torque fluctuation in the retard direction of the vane rotor 14 is prevented with the one-way valve 30, while efficiently supplying the hydraulic pressure to the advance chamber 187 thereby improving the advance response characteristic.

Figure 4:
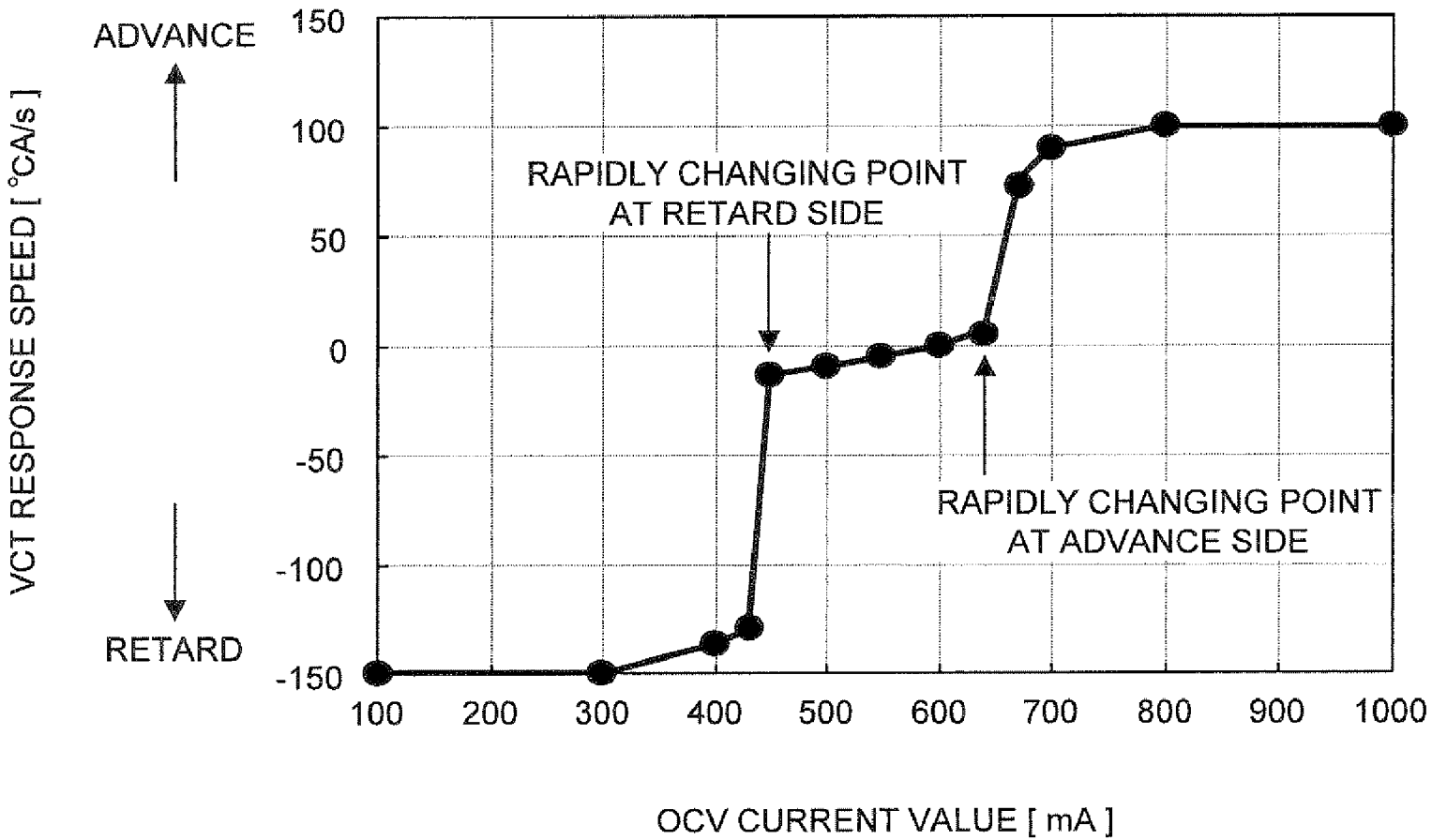
FIG. 4 is a characteristic diagram showing one example of a response characteristic of the variable valve timing adjusting mechanism with a one-way valve.

Next, the response characteristic of the variable valve timing adjusting mechanism 11 (hereinafter referred to as "VCT response characteristic") will be explained with reference to FIG. 4. FIG. 4 shows one example of a VCT response characteristic obtained by measuring a relation between a control current value of the hydraulic control valve 21 (hereinafter, referred to as "OCV current value") and a response speed of the variable valve timing adjusting mechanism 11 (hereinafter, referred to as "VCT response speed").

In the present embodiment, since the one-way valves 30 and 31 and the drain switching valves 34 and 35 are disposed in both of the advance chamber 18 and the retard chamber 19, a VCT response speed does not change linearly to a change of an OCV current value and opening/closing of the drain switching valves 34 and 35 is switched, causing the VCT speed to rapidly change at two locations. In the VCT response characteristic of FIG. 4, the rapidly changing point of the VCT response speed at the retard side is a point where the drain switching valve 34 in the advance chamber 18 switches from closing state to opening state, and the rapidly changing point of the VCT response speed at the advance side is a point where the drain switching valve 35 in the retard chamber 19 switches from closing state to opening state. When an OCV current value at the rapidly changing point of the VCT response speed is learned, it is possible to further improve the control characteristic in a region near where the opening and the closing of the drain switching valves 34 and 35 are switched.

In detail, the VCT response characteristic will be learned as follows.

An OCV current value at the time of holding an actual displacement angle (hereinafter, referred to as "VCT displacement angle") of the variable valve timing adjusting mechanism 11 at an intermediate holding mode at a target displacement angle is learned as a holding current value. The learned OCV current value is in advance stored in a rewritable, involatile memory such as a backup RAM of ECU 43. In regard to the learning of the holding current value, if a predetermined holding current learning condition is established for each execution of the intermediate holding mode, the holding current learning value may be updated at each time or the learning frequency of the holding current value is made smaller than that of the condition establishment. In addition, the holding current value may be learned for each region of the target displacement angle (or for each engine operating region) or one holding current value in common in all the target displacement angles (or all the engine operating regions) may be learned.

Figure 5:
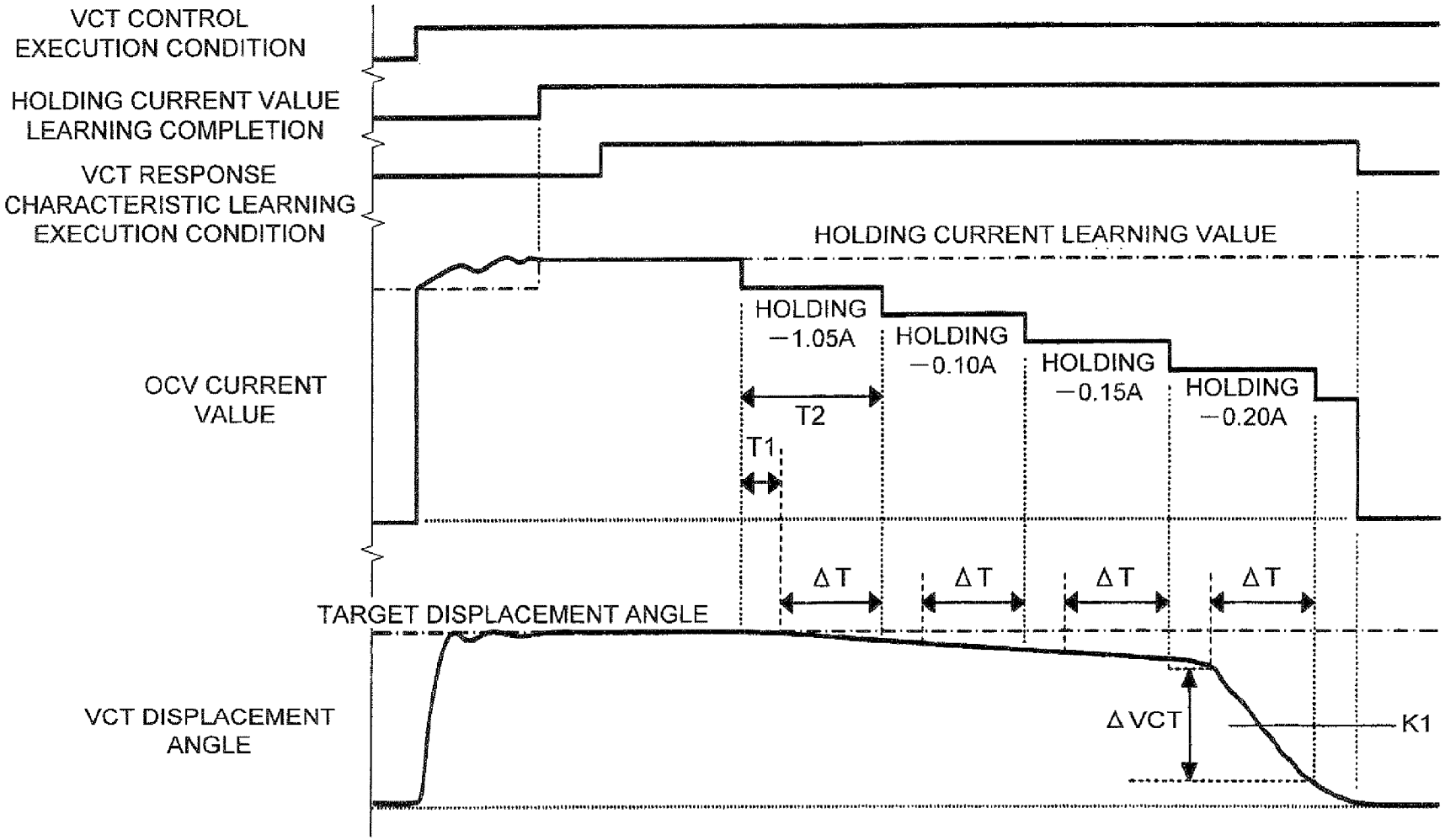
FIG. 5 is a time chart explaining a first learning method of a rapidly changing point of a VCT response speed at a retard side.

Further, in a case of learning a rapidly changing point of the VCT response speed at the retard side, as shown in FIG. 5, an OCV current value is reduced by a predetermined current value (for example, 0.05 A) from a holding current learning value for each predetermined time and the process of measuring a VCT displacement angle changing amount ΔVCT toward the retard side is repeated. In addition, when the VCT displacement angle changing amount ΔVCT toward the retard side exceeds a predetermined value K1 it is determined that the VCT response speed has rapidly changed toward the retard side, the OCV current value immediately before the VCT displacement angle changing amount ΔVCT exceeds the predetermined value K1 is stored as a preliminary learning value of the OCV current value at the rapidly changing point of the VCT response speed at the retard side. In the present embodiment, the preliminary learning value of the OCV current value at the rapidly changing point of the VCT response speed at the retard side is stored as a deviation ΔOCV between the OCV current value and the holding current learning value.

Figure 7:
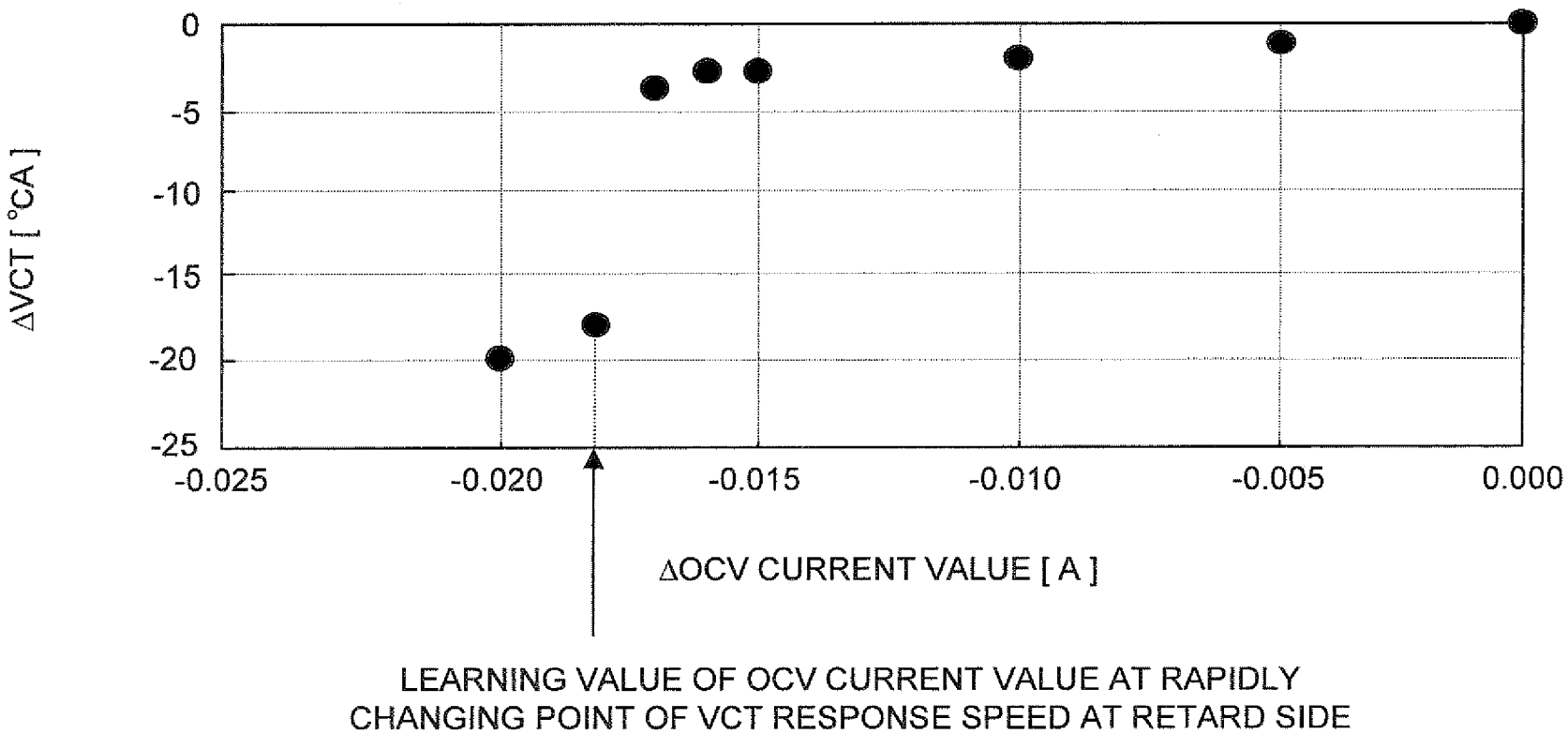
FIG. 7 is a diagram plotting measurement points of a VCT displacement angle changing amount ΔVCT measured at the first and second learning of a rapidly changing point of a VCT response speed at a retard side.

As described above, after the first learning at the rapidly changing point of the VCT response speed at the retard side is roughly carried out, the second learning at the rapidly changing point of the VCT response speed at the retard side is finely carried out as follows. First, the OCV current value (first preliminary learning value) immediately before the VCT displacement angle changing amount ΔVCT detected at the first retard-side rapidly changing point learning exceeds the predetermined value K1 is set to an initial current value at the second retard-side rapidly changing point learning. Further, the OCV current value is reduced at every predetermined time by a predetermined current value (for example, 0.01 A) finer than at the first retard-side rapidly changing point learning to repeat the process of measuring the VCT displacement angle changing amount ΔVCT toward the retard side. In addition, when the VCT displacement angle changing amount ΔVCT toward the retard side exceeds the predetermined value K1, it is determined that the VCT response speed has rapidly changed toward the retard side. Then, an OCV current value at a point when the VCT displacement angle changing amount ΔVCT exceeds the predetermined value K1 is stored as a final learning value of the OCV current value at the rapidly changing point of the VCT response speed at the retard side. In the present embodiment, even in the second retard-side rapidly changing point learning, an OCV current value at the rapidly changing point of the VCT response speed at the retard side is, as shown in FIG. 7, learned by a deviation ΔOCV between the OCV current value and the holding current learning value.

Figure 8:
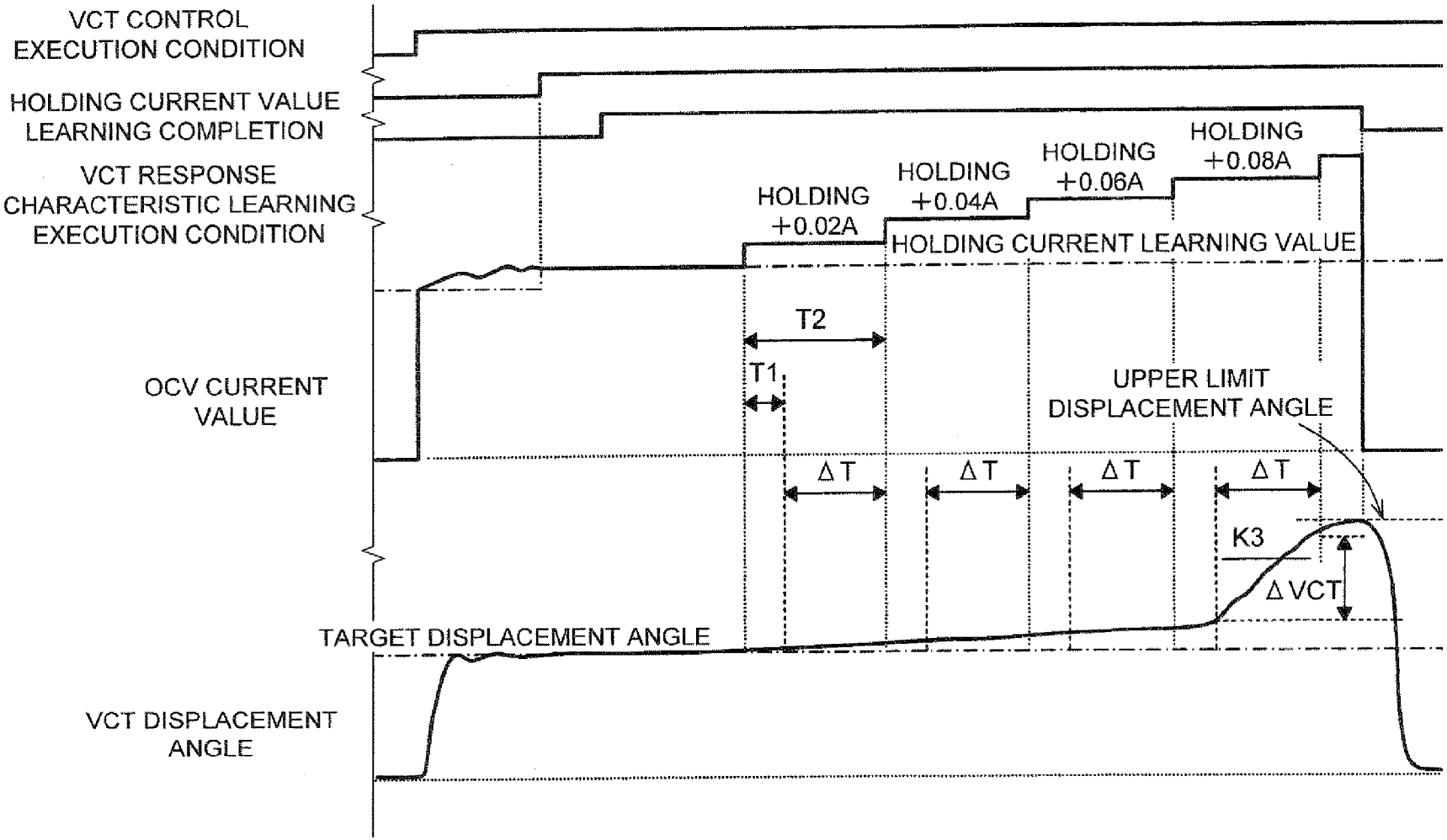
FIG. 8 is a time chart explaining a first learning method of a rapidly changing point of a VCT response speed at an advance side.

On the other hand, the learning of a rapidly changing point of a VCT response speed at an advance side is also performed as the described above. First, as shown in FIG. 8, the OCV current value is increased by a predetermined current value (for example, 0.02 A) for each predetermined time from the holding current value. In addition, the process of measuring a VCT displacement angle changing amount ΔVCT toward the advance side is repeated. Further, when the VCT displacement angle changing amount ΔVCT toward the advance side exceeds a predetermined value K3, it is determined that the VCT response speed has rapidly changed toward the advance side. Then, the OCV current value immediately before the VCT displacement angle changing amount ΔVCT exceeds the predetermined value K3 is stored as a preliminary learning value of the OCV current value at the rapidly changing point of the VCT response speed at the advance side. In the present embodiment, the preliminary learning value of the OCV current value at the rapidly changing point of the VCT response speed at the advance side is stored as a deviation ΔOCV between the OCV current value and the holding current learning value.

Figure 10:
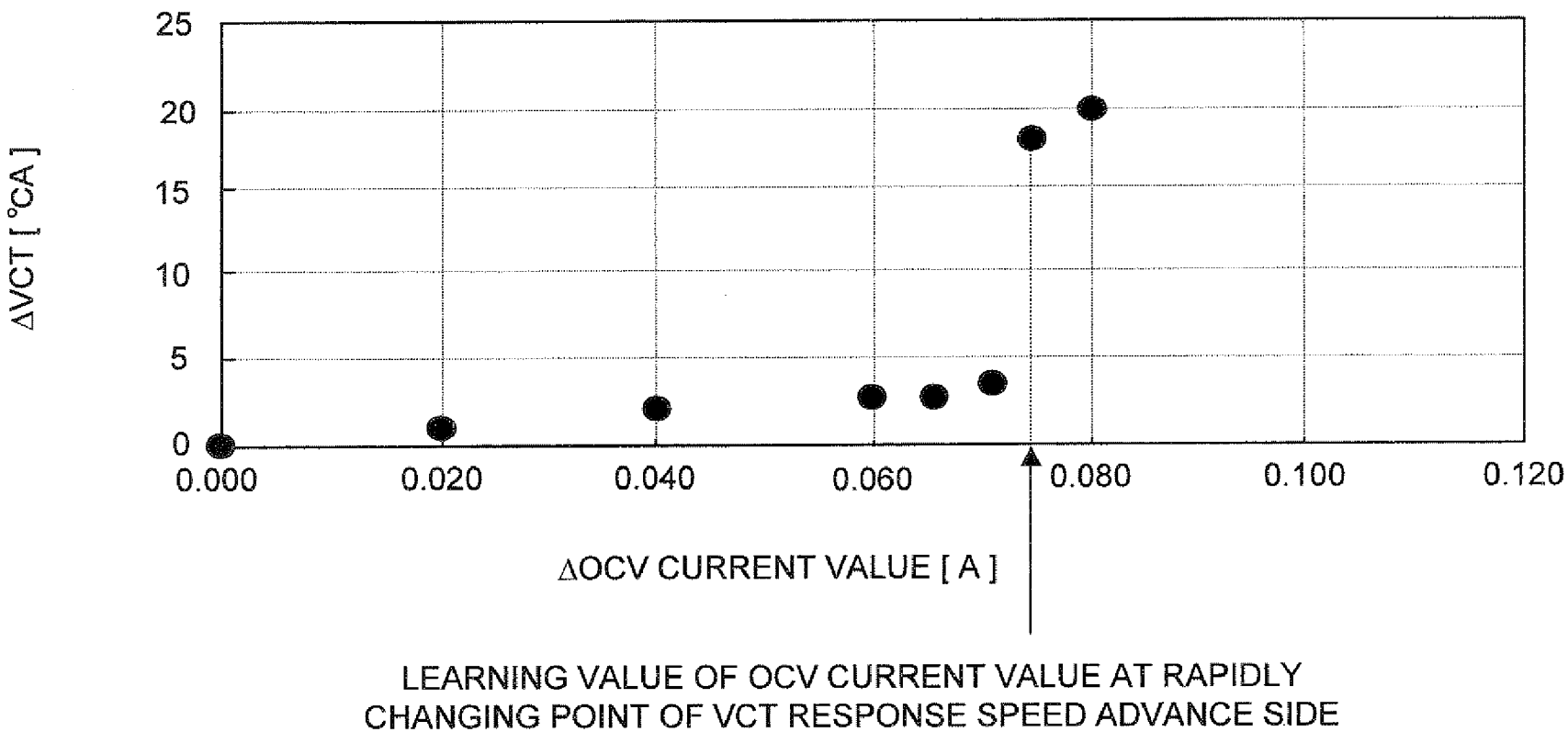
FIG. 10 is a diagram plotting measurement points of a VCT displacement angle changing amount ΔVCT measured at the first and second learning of a rapidly changing point of a VCT response speed at an advance side.

As described above, after the first learning at the rapidly changing point of the VCT response speed at the advance side is roughly carried out, the second learning at the rapidly changing point of the VCT response speed at the advance side is finely carried out as follows. First, the OCV current value (first preliminary learning value) immediately before the VCT displacement angle changing amount ΔVCT detected at the first advance-side rapidly changing point learning exceeds the predetermined value K3 is set to an initial current value at the second advance-side rapidly changing point learning. Further, the OCV current value is increased at every predetermined time by a predetermined current value (for example, 0.05 A) finer than at the first advance-side rapidly changing point learning to repeat the process of measuring the VCT displacement angle changing amount ΔVCT toward the advance side, In addition, when the VCT displacement angle changing amount ΔVCT toward the advance side exceeds the predetermined value K3, it is determined that the VCT response speed has rapidly changed toward the advance side. Then, the OCV current value at a point when the VCT displacement angle changing amount ΔVCT exceeds the predetermined value K3 is stored as a final learning value of the OCV current value at the rapidly changing point of the VCT response speed at the advance side. In the present embodiment, even in the second advance-side rapidly changing point learning, the OCV current value at the rapidly changing point of the VCT response speed at the advance side is, as shown in FIG. 10, learned by a deviation ΔOCV between the OCV current value and the holding current learning value.

However, when a target displacement angle at a normal control time is near the maximum retard position, as the rapidly changing point of the VCT response speed at the advance side is to be learned, it is required to advance an actual displacement angle over the target displacement angle. Therefore, a combustion condition of the engine possibly deteriorates.

For coping with this problem, in the present embodiment, as shown in FIG. 11, in an operating region where the target displacement angle at the normal control time is advanced to more than a predetermined value (for example, 40° CA), the VCT response characteristic is designed to be learned. In this way, as compared to a case of learning the VCT response characteristic in an operating region where the target displacement angle at the normal control time is advanced only to less than a predetermined value (for example, 20° CA), it is possible to detect the larger VCT displacement angle changing amount ΔVCT. As a result, a highly accurate VCT response characteristic can be learned.

Figure 12:
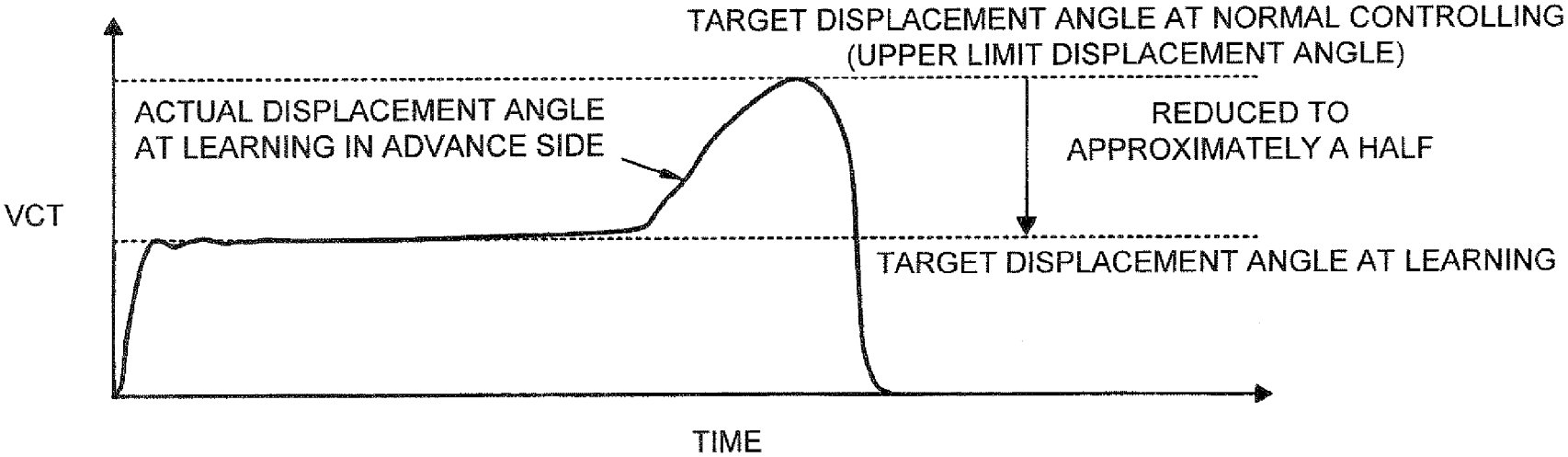
FIG. 12 is a time chart explaining a setting method of a target displacement angle at VCT response characteristic learning.

In addition, in the present embodiment, as shown in FIG. 12, a target displacement angle at the time of learning a VCT response characteristic is to be set to approximately a half of the target displacement angle at the normal control time. In this way, response characteristics in both the directions of the retard side and the advance side can be substantially equally learned and it is also prevented that an actual displacement angle exceeds an upper limit displacement angle at the time of learning the response characteristic at the advance side. Thereby, the problem due to an excessive advance can be prevented.

Figure 13:
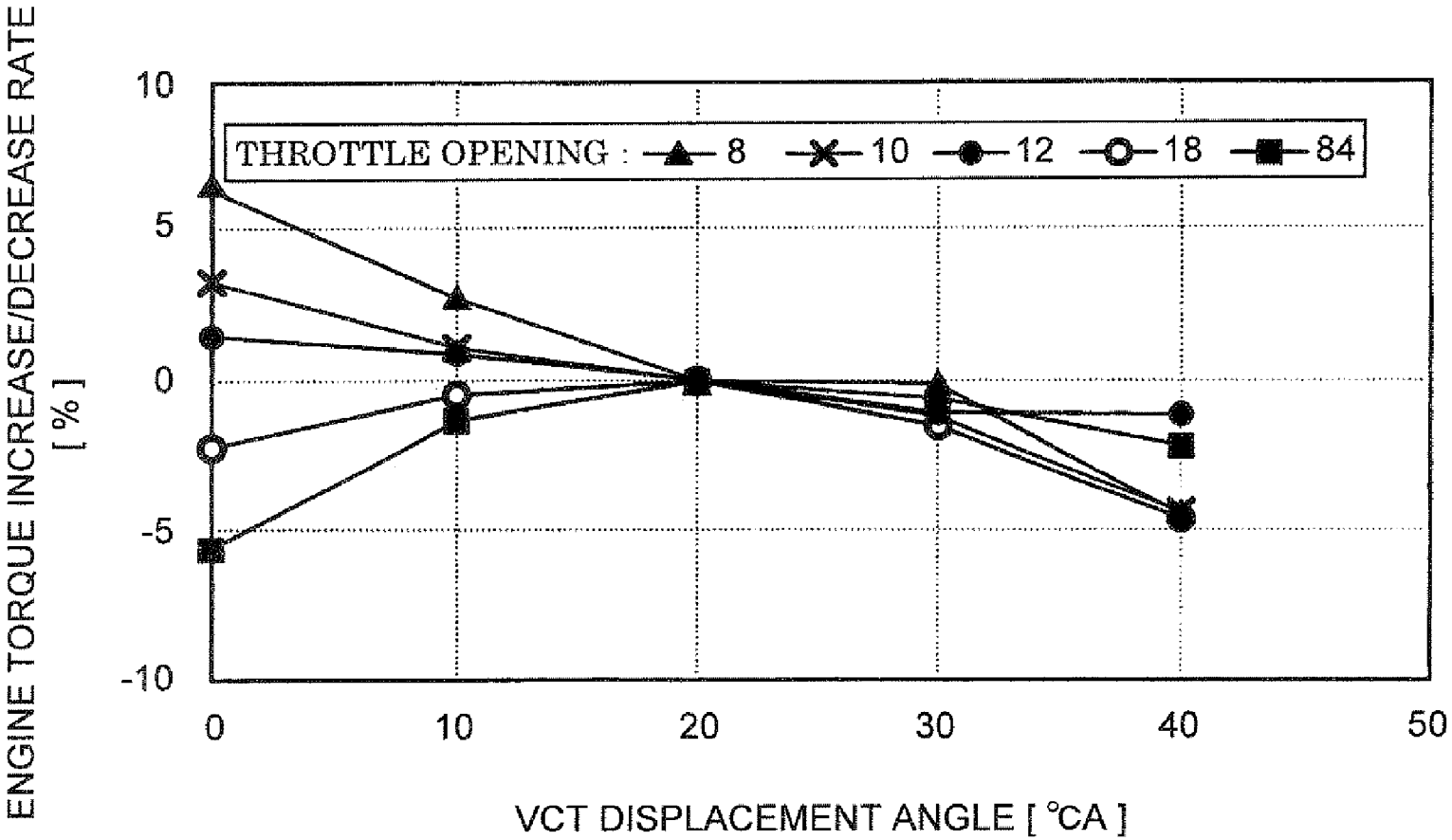
FIG. 13 is a characteristic diagram representing one example of an engine torque increasing/decreasing rate characteristic to a VCT displacement angle at a constant throttle opening.

As shown in FIG. 13, however, when a VCT displacement is changed at the time of learning the VCT response characteristic, the engine torque possibly changes. When the engine torque changes largely, it gives a driver a strange feeling.

For coping with this problem, in the present embodiment, the VCT response characteristic is designed to be learned in an operating region where a change of the engine torque to that of the VCT displacement angle is small. In this way, since the change of the engine torque due to the change of the VCT response characteristic at the time of learning the VCT response characteristic is made small, the VCT response characteristic can be learned without nearly giving a driver a strange feeling.

In addition, before completing the learning of the VCT response characteristic, a point where the VCT response speed rapidly changes is unclear. Therefore, when the OCV current value is controlled in the vicinity of the rapidly changing point of the VCT response characteristic, the VCT response speed rapidly changes unexpectedly, thus possibly generating overshoot or undershoot of the VCT displacement angle.

Figure 14:
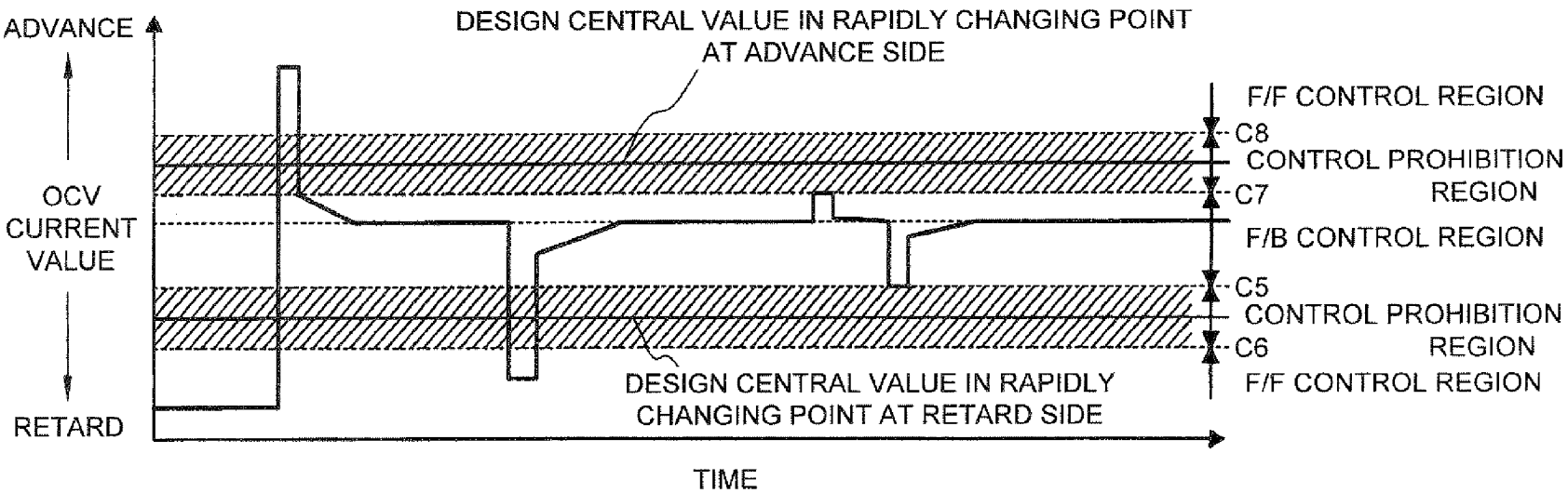
FIG. 14 is a time chart explaining a control example before completing learning of a VCT response characteristic.

For coping with this problem, as shown in FIG. 14, a control prohibition region is set in the vicinity of the rapidly changing point of the VCT response speed at each of the advance side and the retard side before completing the learning of the VCT response characteristic, in consideration of a range of manufacturing variations on a basis of a design central value of the rapidly changing point of the VCT response speed at each of the advance side and the retard side. In consequence, it is prohibited to control the OCV current value in the vicinity of the rapidly changing point of the VCT response speed. In addition, the OCV current value is feedback-controlled in an intermediate region sandwiched by the two control prohibition regions so that a deviation between the VCT displacement angle and the target displacement angle is made small. Further, then OCV current value is feedforward-controlled at an region of a further advance side from the control prohibition region at the advance side and at an region of a further retard side from the control prohibition region at the retard side, thereby increasing the VCT response speed.

Figure 15:
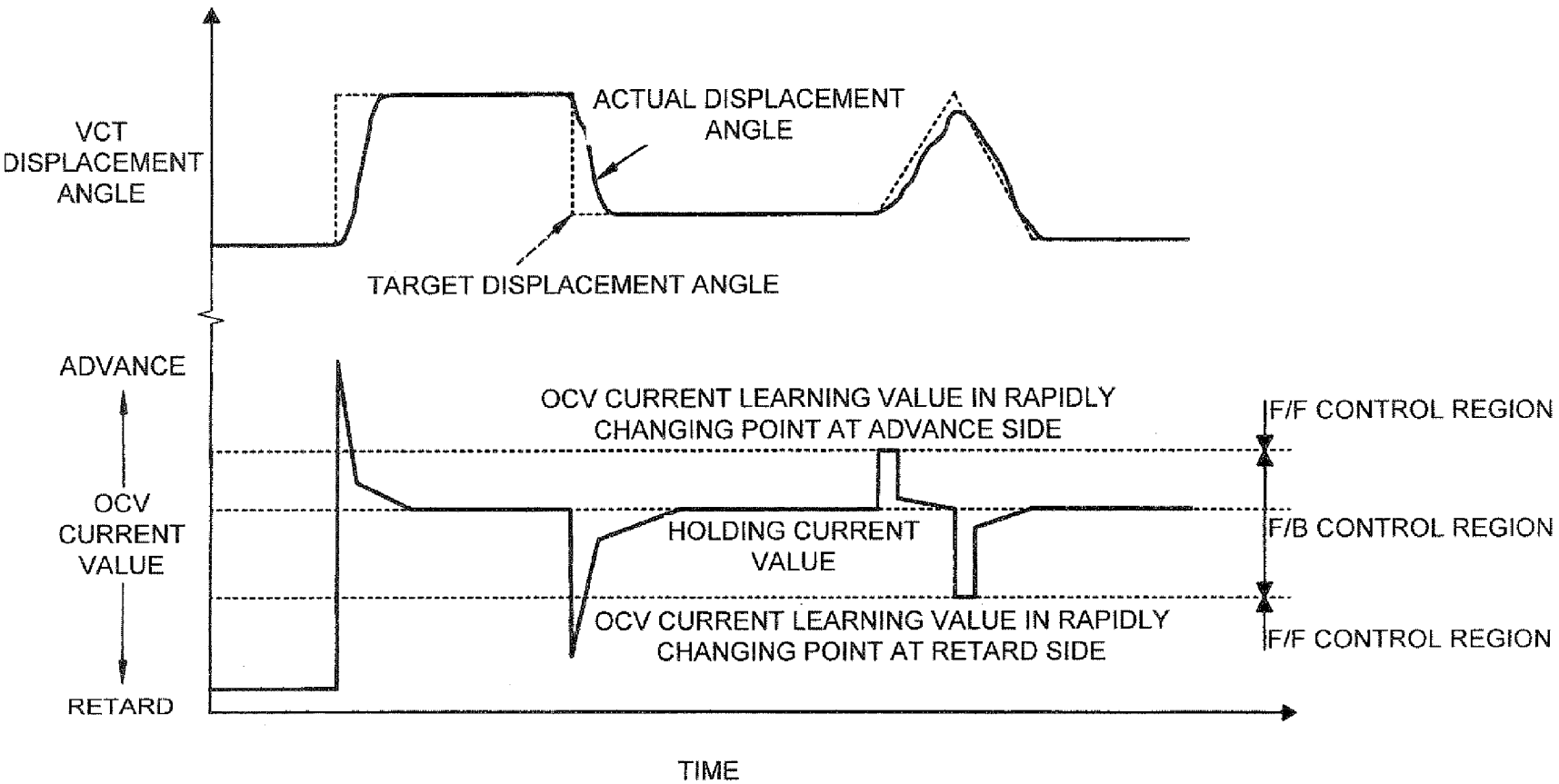
FIG. 15 is a time chart explaining a control example after completing learning of a VCT response characteristic.

On the other hand, as shown in FIG. 15, the two control prohibition regions are eliminated after completing the learning of a VCT response characteristic. In addition, the OCV current value is feedback-controlled in an region between the OCV current learning value of the rapidly changing point of the VCT response speed at the advance side and the OCV current learning value of the rapidly changing point of the VCT response speed at the retard side so that a deviation between the VCT displacement angle and the target displacement angle is made small. Further, the OCV current value is feedforward-controlled in a region outside of the feedback control region, thereby increasing the VCT response speed.

The learning processing of the aforementioned VCT response characteristic is executed according to each routine of FIGS. 16 to 20 by ECU 43. Hereinafter, the processing content of each routine will be explained.

[Determination Routine of a Learning Execution Condition for a VCT Response Characteristic]

Figure 16:
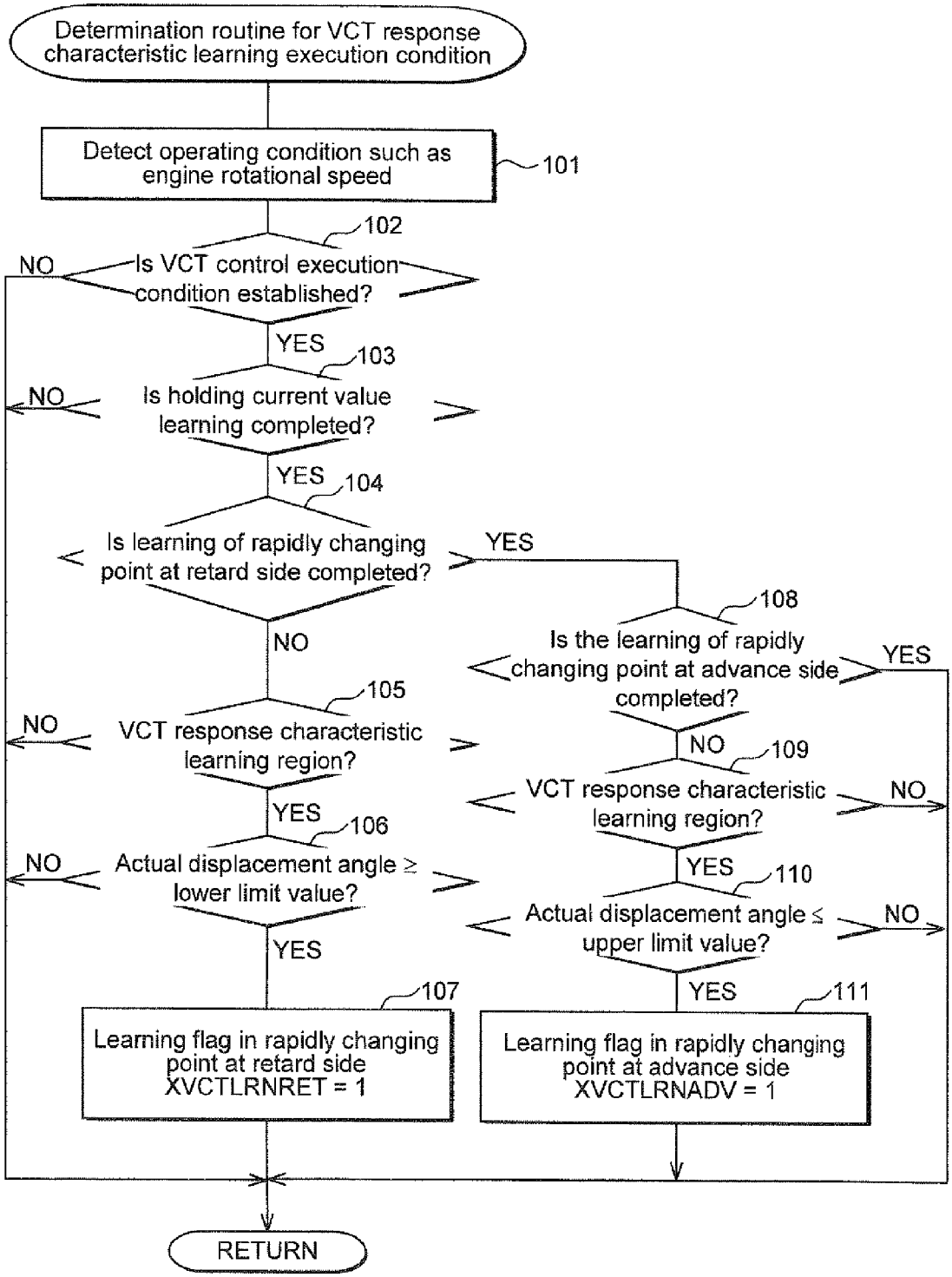
FIG. 16 is a flow chart explaining the process flow in a determination routine for a learning execution condition of a VCT response characteristic.

A determination routine of a learning execution condition for a VCT response characteristic in FIG. 16 is executed in a predetermined period during engine operating. When the present routine is activated, first at step 101, an engine operating condition such as an engine rotational speed, an intake pressure and a cooling water temperature are detected. At next step 102, it is determined whether or not a VCT control execution condition is established depending on whether or not the detected engine operating condition is within a VCT control execution region. When the VCT control execution condition is not established, the present routine ends as it is, and when the VCT control execution condition is established, the process goes to step 103, wherein it is determined whether or not the learning of a holding current value is completed.

When it is determined at step 103 that the learning of the holding current value is not completed yet, the present routine ends as it is, and when it is determined at step 103 that the learning of the holding current value is already completed, the process goes to step 104, wherein it is determined whether or not the learning of the rapidly changing point of the VCT response speed at the retard side is completed. When it is determined that the learning of the rapidly changing point of the VCT response speed at the retard side is not completed yet, the process goes to step 105, wherein it is determined whether or not the present engine operating condition (engine rotational speed, intake pressure and the like) is within a VCT response characteristic learning region shown in FIG. 11.

When it is determined at step 105 that the present engine operating condition is not within the VCT response characteristic learning region, the present routine ends as it is. When it is determined that the present engine operating condition is within the VCT response characteristic learning region, the process goes to step 106, wherein it is determined whether or not an actual displacement angle is more than a lower limit value. Here, the lower limit value is set to a displacement angle required for preventing a problem such as a combustion deterioration caused by a learning operation (retard operation) of the rapidly changing point of the VCT response speed at the retard side.

When it is determined at step 106 that the actual displacement angle is less than the lower limit value, it is determined that the learning condition in the rapidly changing point at the retard side is not established, the present routine ends as it is. When it is determined at step 106 that the actual displacement angle is more than the lower limit value, it is determined that the learning condition in the rapidly changing point at the retard side is established, and the process goes to step 107. Therein a learning flag of the rapidly changing point at the retard side XVCTLRNRET is set to "1" which means a learning condition establishment of the rapidly changing point at the retard side, and the present routine ends.

On the other hand, when it is determined at step 104 that the learning of the rapidly changing point of the VCT response speed at the retard side is completed, the process goes to step 108, wherein it is determined whether or not the learning of the rapidly changing point of the VCT response speed at the advance side is completed. When the learning of the rapidly changing point of the VCT response speed at the advance side is completed, the present routine ends as it is. When the learning of the rapidly changing point of the VCT response speed at the advance side is not completed, the process goes to step 109, wherein it is determined whether or not the present engine operating condition (engine rotational speed, intake pressure and the like) is within the VCT response characteristic learning region shown in FIG. 11.

When it is determined at step 109 that the present engine operating condition is not within the VCT response characteristic learning region, the present routine ends as it is. When it is determined that the present engine operating condition is within the VCT response characteristic learning region, the process goes to step 110, wherein it is determined whether or not an actual displacement angle is less than an upper limit value. Here, the upper limit value is set to a displacement angle required for preventing a problem such as a combustion deterioration caused by a learning operation (advance operation) of the rapidly changing point of the VCT response speed at the advance side.

When it is determined at step 110 that the actual displacement angle is more than the upper limit value, it is determined that the learning condition in the rapidly changing point at the advance side is not established, the present routine ends as it is. When it is determined at step 110 that the actual displacement angle is less than the upper limit value, it is determined that the learning condition in the rapidly changing point at the advance side is established, and the process goes to step 111. Therein a learning flag of the rapidly changing point at the advance side XVCTLRNADV is set to "1" which means a learning condition establishment of the rapidly changing point at the advance side, and the present routine ends.

[Learning Routine for a VCT Response Characteristic]

Figure 17:
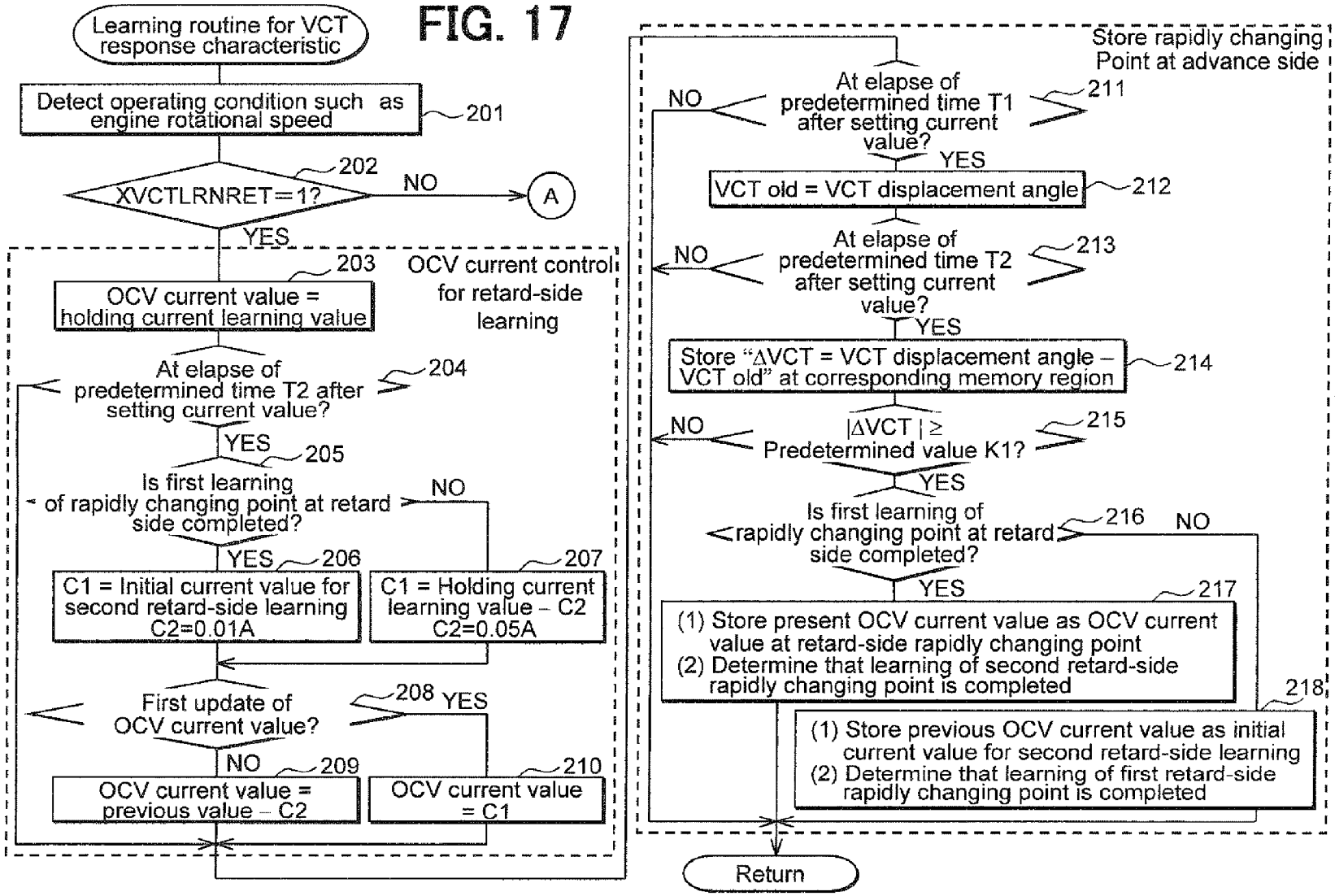
FIG. 17 is a flow chart explaining the process flow in a learning routine for a VCT response characteristic.
Figure 18:
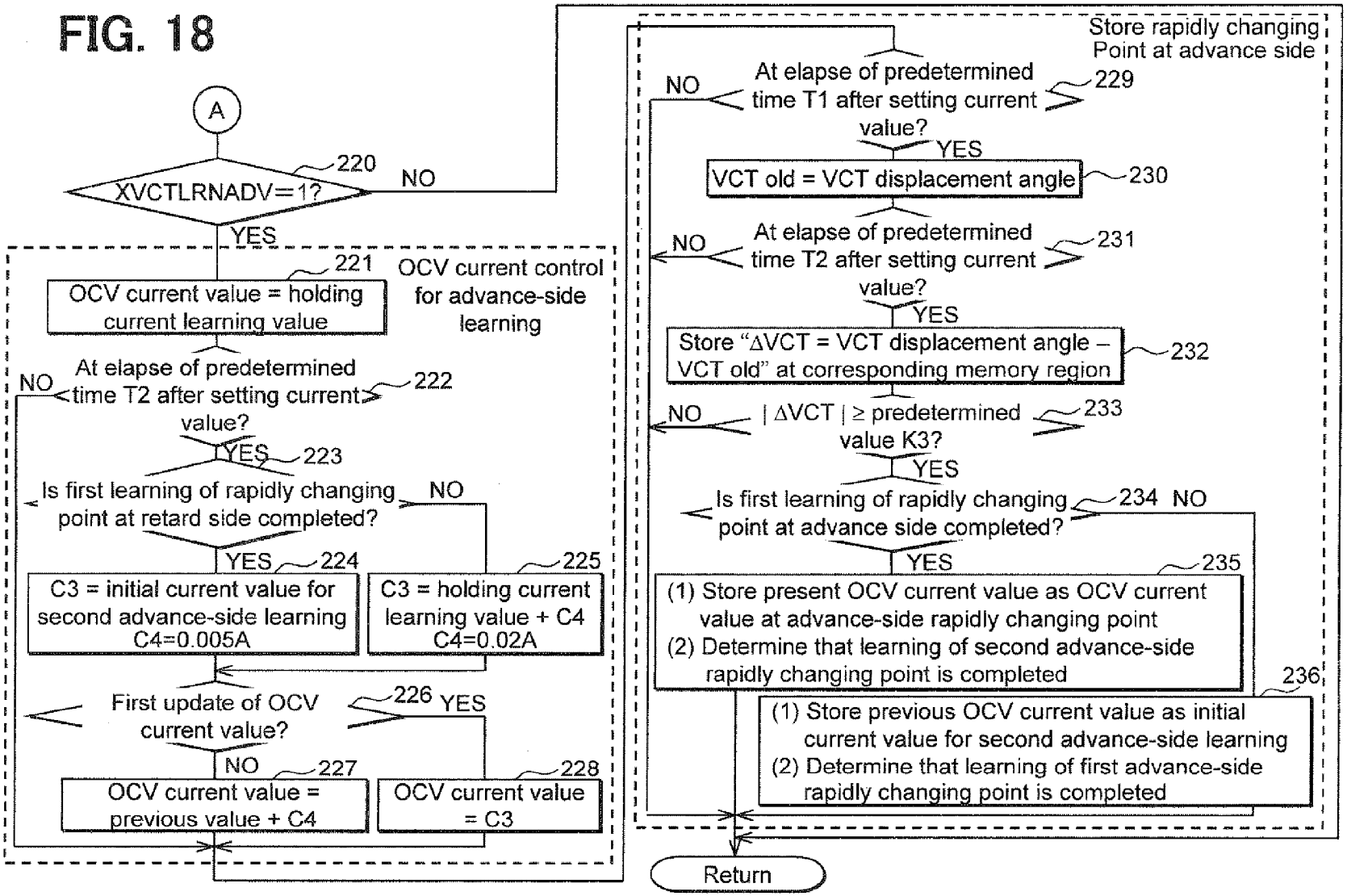
FIG. 18 is a flow chart explaining the process flow in a learning routine for a VCT response characteristic.

A learning routine for a VCT response characteristic in FIGS. 17 and 18 is executed in a predetermined period during engine operating. When the present routine is activated, first at step 201, an engine operating condition such as an engine rotational speed, an intake pressure and a cooling water temperature is detected. At next step 202, it is determined whether or not the learning flag of the rapidly changing point at the retard side XVCTLRNRET is set to "1" which means the learning condition establishment of the rapidly changing point at the retard side. When the learning flag is set to "1", the OCV current value of the rapidly changing point of the VCT response speed at the retard side is learned as below.

First, at step 203 the OCV current value is set to the holding current learning value and at next step 204, after setting the OCV current value, it is determined whether or not a predetermined time T2 has elapsed. When the answer is "No", the process goes to step 211. When the answer is "Yes", the process goes to step 205, wherein it is determined whether or not the first learning of the rapidly changing point at the retard side (the first learning of the rapidly changing point of the VCT response speed at the retard side) is completed. As a result, when it is determined that the first learning of the rapidly changing point at the retard side is not completed yet, the process goes to step 207, wherein a value C1 is calculated by subtracting a predetermined current value C2 (C2=0.05 A) from the holding current value learning value. When it is determined that the first learning of the rapidly changing point at the retard side is completed, the process goes to step 206, wherein an initial current value for the second learning at the retard side is set to the C1 and also a current value (for example, 0.01 A) smaller than at the first learning of the rapidly changing point at the retard side is set to a predetermined current value C2.

Thereafter, the process goes to step 208, wherein it is determined whether or not the OCV current value is updated for the first time. When it is updated for the first time, the process goes to step 210, wherein the OCV current value of this time is set to C1 (=holding current value−C2). When it is not updated for the first time, the process goes to step 209, wherein a value which is made by subtracting a predetermined current value C2 from the previous OCV current value is set to the OCV current value of this time.

Figure 6:
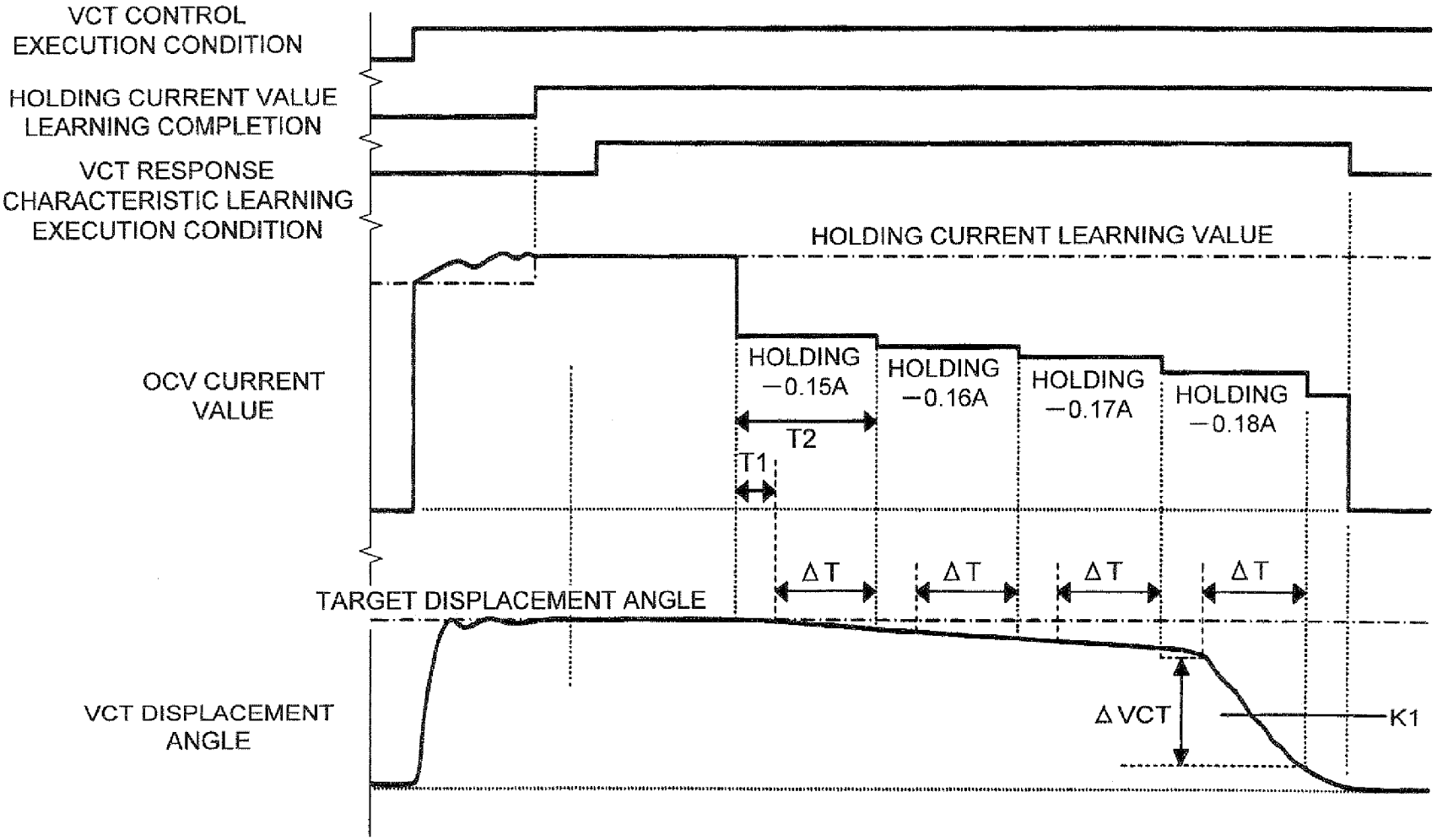
FIG. 6 is a time chart explaining a second learning method of a rapidly changing point of a VCT response speed at a retard side.

By the processing of steps 203 to 210 as described above, in the first learning of the rapidly changing point at the retard side (the first learning of the rapidly changing point of the VCT response speed at the retard side), as shown in FIG. 5, the process of reducing the OCV current value by the predetermined current value C2 (for example, 0.05 A) from the holding current learning value at every predetermined time is repeated. In the second learning of the rapidly changing point at the retard side (the second learning of the rapidly changing point of the VCT response speed at the retard side), as shown in FIG. 6, the process of reducing the OCV current value by the predetermined current value C2 (for example, 0.01 A) from the initial current value for the second learning at the retard side (preliminary learning value by the first learning of the rapidly changing point at the retard side) at every predetermined time is repeated. Here, the initial current value for the second learning at the retard side is an OCV current value immediately before an absolute value of the VCT displacement angle changing amount ΔVCT detected at the first learning of the rapidly changing point at the retard side exceeds the predetermined value K1 and is set at step 218 to be described later.

As described above, after setting the OCV current value, the process goes to step 211, wherein it is determined whether or not a predetermined time T1 has elapsed after setting the OCV current value. When the answer is "No", the present routine ends as it is. When the answer is "Yes", the process goes to step 212, wherein the present displacement angle is set to a VCT old. Thereafter, the process goes to step 213, wherein it is determined whether or not a predetermined time T2 has elapsed after setting the OCV current value. When the answer is "No", the present routine ends as it is. When the answer is "Yes", the process goes to step 214, and a value which is made by subtracting the VCT old from the present VCT displacement angle is calculated as a VCT displacement angle changing amount ΔVCT for ΔT time (predetermined time from T1 to T2). In addition, the VCT displacement angle changing amount ΔVCT is stored in the corresponding memory area of a memory in ECU 43.

$$\Delta VCT = VCT\ displacement\ angle - VCT\ old.$$

Thereafter, the process goes to step 215, wherein it is determined whether or not an absolute value of the VCT displacement angle changing amount ΔVCT is more than a predetermined value K1. When the absolute value of the VCT displacement angle changing amount ΔVCT is less than the predetermined value K1, it is determined that the VCT response speed does not rapidly change yet, and the present routine ends as it is. Thereafter, at a point where the absolute value of the VCT displacement angle changing amount ΔVCT is more than the predetermined value K1, it is determined that the VCT response speed has changed rapidly, and the process goes to step 216, wherein it is determined whether or not the first learning of the rapidly changing point at the retard side is completed. As a result, when the first learning of the rapidly changing point at the retard side is not yet completed, the process goes to step 218. (1) Therein the previous OCV current value is determined to the preliminary learning value by the first learning of the rapidly changing point at the retard side, which is stored as the initial current value for the second learning at the retard side. Further, it is determined that the first learning of the rapidly changing point at the retard side is completed.

In addition, when it is determined at step 216 that the first learning of the rapidly changing point at the retard side is completed, the process goes to step 217, wherein (1) the present OCV current value is stored in a rewritable, involatile memory such as a backup RAM of ECU 43 as a final learning value of the OCV current value of the rapidly changing point of the VCT response speed at the retard side. Further, it is determined that the second learning of the rapidly changing point at the retard side is completed.

On the other hand, when it is determined at step 202 that the learning flag of the rapidly changing point at the retard side XVCTLRNRET is set to "0" which means that the learning condition of the rapidly changing point at the retard side is not established, the process goes to step 220 in FIG. 18. Therein it is determined whether or not the learning flag of the rapidly changing point at the advance side XVCTLRNADV is set to "1" which means that the learning condition of the rapidly changing point at the advance side is established. When the learning flag of the rapidly changing point at the advance side XVCTLRNADV is not set to "1", the present routine ends as it is and when the learning flag is set to "1", the OCV current value of the rapidly changing point at the advance side is learned as follows.

First, at step 221 the OCV current value is set to the holding current learning value and at next step 222, it is determined whether or not a predetermined time T2 has elapsed after setting the OCV current value. When the answer is "No", the process goes to the process at step 229. When the answer is "Yes", the process goes to step 223, wherein it is determined whether or not the first learning of the rapidly changing point at the advance side (the first learning of the rapidly changing point of the VCT response speed at the advance side) is completed. As a result, when it is determined that the first learning of the rapidly changing point at the advance side is not completed yet, the process goes to step 225, wherein a value C3 is calculated by adding a predetermined current value C4 (for example, C4=0.02 A) to the holding current value learning value. When it is determined that the first learning of the rapidly changing point at the advance side is completed, the process goes to step 224, wherein then initial current value for the second learning at the advance side is set to the value C3 and also a current value (0.05 A) smaller than at the first learning of the rapidly changing point at the advance side is set to the predetermined current value C4.

Thereafter, the process goes to step 226, wherein it is determined whether or not the OCV current value is updated for the first time. When it is updated for the first time the process goes to step 228, wherein the OCV current value of this time is set to C3 (=holding current learning value+C4). When it is not updated for the first time, the process goes to step 227, wherein a value which is made by adding the predetermined current value C4 to the previous OCV current value is set to the OCV current value of this time.

Figure 9:
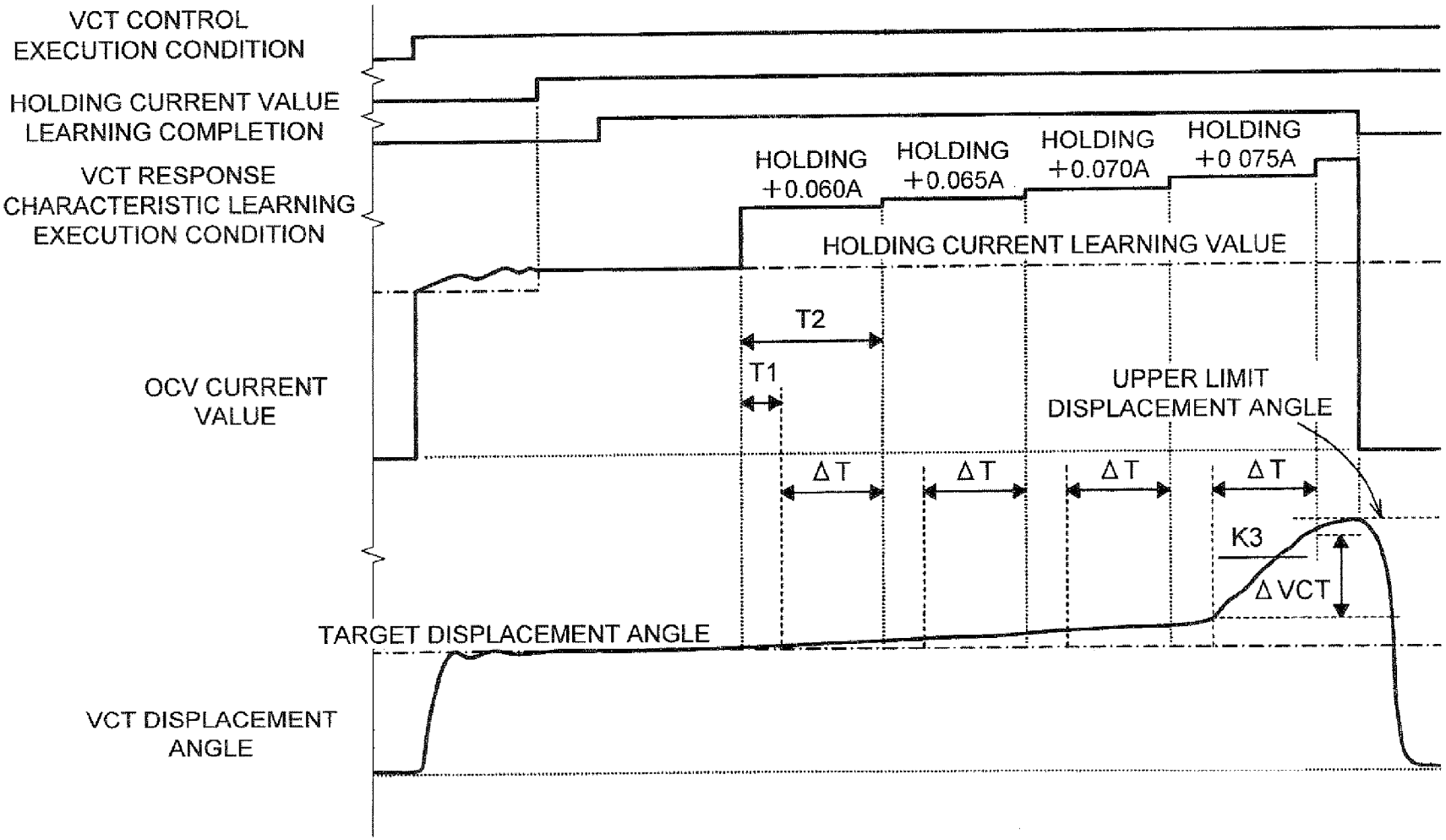
FIG. 9 is a time chart explaining a second learning method of a rapidly changing point of a VCT response speed at an advance side.

By the processing of steps 221 to 228 as described above, in the first learning of the rapidly changing point at the advance side (the first learning of the rapidly changing point of the VCT response speed at the advance side), as shown in FIG. 8, the process of increasing the OCV current value by the predetermined current value C4 (for example, 0.02 A) from the holding current learning value at every predetermined time is repeated. In the second learning of the rapidly changing point at the advance side (the second learning of the rapidly changing point of the VCT response speed at the advance side), as shown in FIG. 9, the process of increasing the OCV current value by the predetermined current value C4 (for example, 0.05 A) from the initial current value for the second learning at the advance side (preliminary learning value by the first learning of the rapidly changing point at the advance side) at every predetermined time is repeated. Here, the initial current value for the second learning at the advance side is an OCV current value immediately before an absolute value of the VCT displacement angle changing amount ΔVCT detected at the first learning of the rapidly changing point at the advance side exceeds the predetermined value K3 and is set at step 236 to be described later.

As described above, after setting the OCV current value, the process goes to step 229, wherein it is determined whether or not a predetermined time T1 has elapsed after setting the OCV current value. When the answer is "No", the present routine ends as it is. When the answer is "Yes" the process goes to step 230, wherein the present displacement angle is set to a VCTold. Thereafter, the process goes to step 231, wherein it is determined whether or not a predetermined time T2 has elapsed after setting the OCV current value. When the answer is "No", the present routine ends as it is. When the answer is "Yes", the process goes to step 232, and a value which is made by subtracting the VCT old from the present VCT displacement angle is calculated as a VCT displacement angle changing amount ΔVCT for ΔT time (predetermined time from T1 to T2). In addition, the VCT displacement angle changing amount ΔVCT is stored in the corresponding memory region of a memory in ECU 43.

$$\Delta VCT = VCT\ displacement\ angle - VCTold.$$

On this occasion, a deviation ΔVCT between the OCV current value and the holding current learning value is used as a data of the OCV current value. In consequence, there is produced a table of the VCT displacement angle changing amount ΔVCT using the deviation ΔVCT between the OCV current value and the holding current learning value as a parameter.

Thereafter, the process goes to step 233, wherein it is determined whether or not an absolute value of the VCT displacement angle changing amount ΔVCT is more than the predetermined value K3. When the absolute value of the VCT displacement angle changing amount ΔVCT is less than the predetermined value K3, it is determined that the VCT response speed does not rapidly change yet, and the present routine ends as it is. Thereafter, at a point where the absolute value of the VCT displacement angle changing amount ΔVCT is more than the predetermined value K3, it is determined that the VCT response speed has changed rapidly, the process goes to step 234, wherein it is determined whether or not the first learning of the rapidly changing point at the advance side is completed. As a result, when the first learning of the rapidly changing point at the advance side is not yet completed, the process goes to step 236. (1) Therein the previous OCV current value is determined as a preliminary learning value by the first learning of the rapidly changing point at the advance side, which is stored as an initial current value for the second learning at the advance side. Further, it is determined that the first learning of the rapidly changing point at the advance side is completed.

In addition, when it is determined at step 234 that the first learning of the rapidly changing point at the advance side is completed, the process goes to step 235, wherein (1) the present OCV current value is stored in a rewritable, involatile memory such as a backup RAM of ECU 43 as a final learning value of the OCV current value of the rapidly changing point of the VCT response speed at the advance side. Further, it is determined that the second learning of the rapidly changing point at the advance side is completed.

[Control Routine for an OCV Current]

Figure 19:
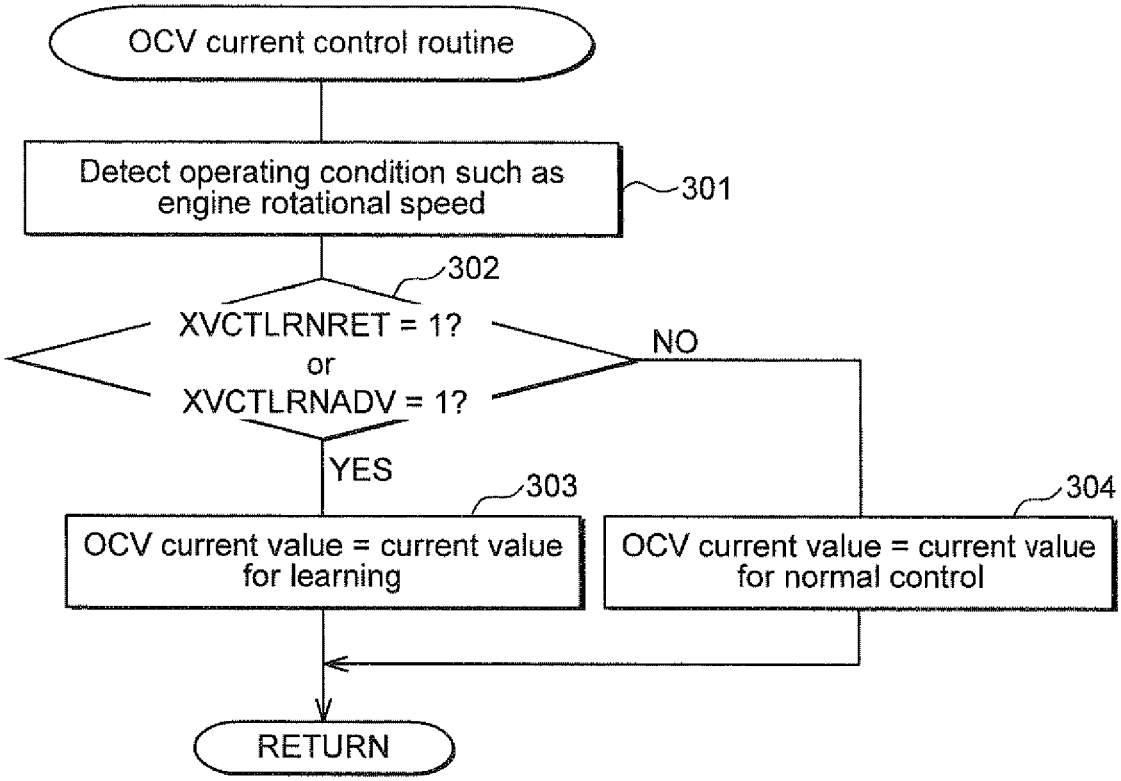
FIG. 19 is a flow chart explaining the process flow in a control routine for an OCV current.

A control routine for an OCV current in FIG. 19 is executed in a predetermined period during engine operating. When the present routine is activated, first at step 301, an engine operating condition such as an engine rotational speed, an intake pressure and a cooling water temperature is detected. At next step 302, it is determined whether or not the learning flag of the rapidly changing point at the retard side XVCTLRNRET is "1" or the learning flag of the rapidly changing point at the advance side XVCTLRNADV is "1". When one of the learning flag of the rapidly changing point at the retard side XVCTLRNRET and the learning flag of the rapidly changing point at the advance side XVCTLRNADV is "1", it is determined that the VCT response characteristic is in the middle of being learned. In addition, the process goes to step 303, wherein a current value for learning is set to the OCV current value and the present routine ends. This current value for learning is the OCV current value in the middle of learning the VCT response characteristic calculated at steps 209, 210, 227 and 228 in the learning routine of the VCT response characteristic in FIGS. 17 and 18

On the other hand, when both of the learning flag of the rapidly changing point at the retard side XVCTLRNRET and the learning flag of the rapidly changing point at the advance side XVCTLRNADV are "0", it is determined that the VCT response characteristic is during normal controlling. In addition, the process goes to step 304, wherein a current value for normal control is set to the OCV current value and the present routine ends. This current value for normal control is an OCV current value calculated at normal controlling in a calculation routine of a current value for normal control in FIG. 20 to be described later.

[Calculation Routine of a Current Value for Normal Control]

Figure 20:
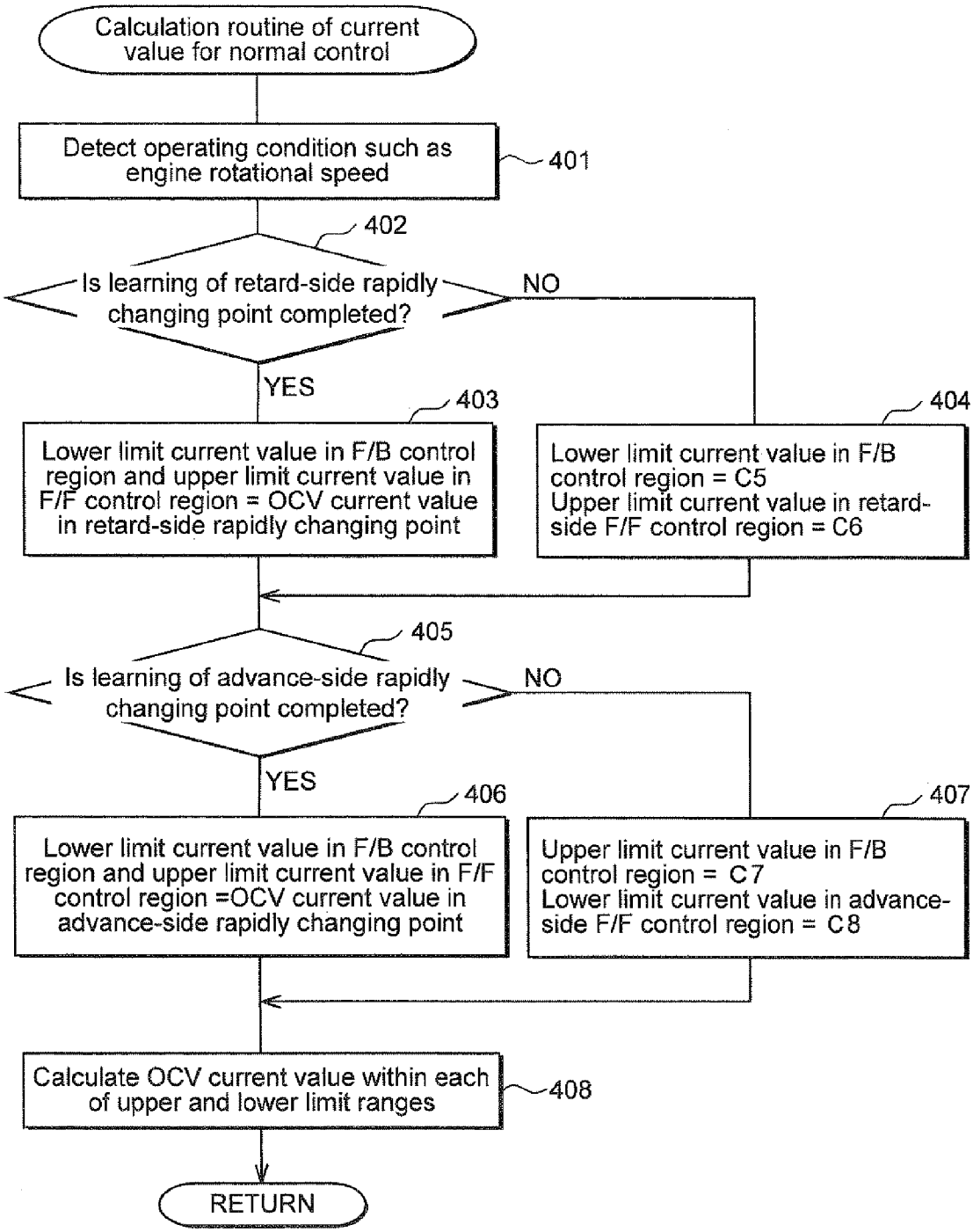
FIG. 20 is a flow chart explaining the process flow in a calculation routine for a current value for normal control.

A calculation routine for a current value for normal control in FIG. 20 is executed in a predetermined period during engine operating. When the present routine is activated, first at step 401, an engine operating condition such as an engine rotational speed, an intake pressure and a cooling water temperature is detected. At next step 402, it is determined whether or not the learning of the rapidly changing point of the VCT response speed at the retard side is completed. When the learning of the rapidly changing point of the VCT response speed at the retard side is not completed yet, the process goes to step 404. Therein, as shown in FIG. 14, a lower limit current value in the feedback control region is set to a predetermined value C5 and also an upper limit current value in the feedforward control region at the retard side is set to a predetermined value C6.

On the other hand, when it is determined at step 402 that the learning of the rapidly changing point of the VCT response speed at the retard side is completed, the process goes to step 403. Therein the lower limit current value in the feedback control region and the upper limit current value in the feedforward control region at the retard side both are set to the OCV current learning value in the rapidly changing point of the VCT response speed at the retard side.

Thereafter, the process goes to step 405, and it is determined whether or not the learning of the rapidly changing point of the VCT response speed at the advance side is completed. When the learning of the rapidly changing point of the VCT response speed at the advance side is not completed yet, the process goes to step 406. Therein, as shown in FIG. 14, the upper limit current value in the feedback control region is set to a predetermined value C7 and also the lower limit current value in the feedforward control region at the advance side is set to a predetermined value C8.

In this case, the upper and lower limit current values C7 and C5 in the feedback control region and the upper and lower limit current values C6 and C8 in the feedforward control region are set in consideration of a range of the manufacturing variations on a basis of the design central value in the rapidly changing point of the VCT response speed at each of the advance side and the retard side. As a result, the range of the manufacturing variations in the rapidly changing point of the VCT response speed is within the control prohibition regions (C6 to C5 and C7 to C8) provided between the feedback control region and the feedforward control region.

On the other hand, when it is determined at step 405 that the learning of the rapidly changing point of the VCT response speed at the advance side is completed, the process goes to step 406. Therein the upper limit current value in the feedback control region and the lower limit current value in the feedforward control region at the advance side both are set to the OCV current learning value in the rapidly changing point of the VCT response speed at the advance side.

Thereafter, the process goes to step 408, wherein the OCV current value is calculated in accordance with the deviation between the VCT displacement angle and the target displacement angle, within the upper and lower limit ranges in each of the feedback control region and the feedback control region.

[Calculation Routine for a Target Displacement Angle]

Figure 21:
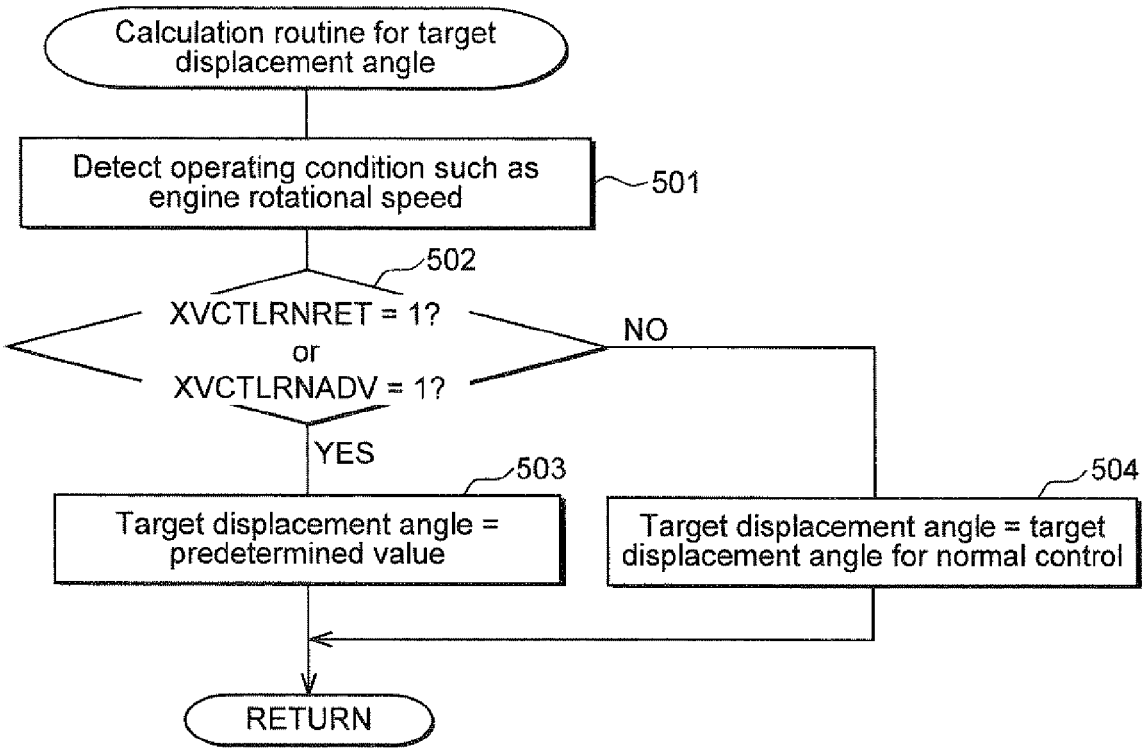
FIG. 21 is a flow chart explaining the process flow in a calculation routine for a target displacement angle.

A calculation routine for a target displacement angle in FIG. 21 is executed in a predetermined period during engine operating. When the present routine is activated, first at step 501, an engine operating condition such as an engine rotational speed, an intake pressure and a cooling water temperature is detected. At next step S502, it is determined whether or not the learning flag of the rapidly changing point at the retard side XVCTLRNRET is "1" or the learning flag of the rapidly changing point at the advance side XVCTLRNADV is "1". When one of the learning flag of the rapidly changing point at the retard side XVCTLRNRET and the learning flag of the rapidly changing point at the advance side XVCTLRNADV is "1", it is determined that the VCT response characteristic is in the middle of being learned. In addition, the process goes to step S503, wherein the target displacement angle is set to a predetermined value of approximately a half of the target displacement angle at normal controlling.

On the other hand, when both of the learning flag of the rapidly changing point at the retard side XVCTLRNRET and the learning flag of the rapidly changing point at the advance side XVCTLRNADV are "0", it is determined that the VCT is in the middle of the normal controlling. In addition, the process goes to step 504, wherein by referring to a map of target displacement angles in the middle of the normal controlling shown in FIG. 11, the target displacement angle is set to a target displacement angle in accordance with the present engine operating condition (engine rotational speed, intake pressure and the like).

According to the present embodiment as described above, in the VCT response characteristic in FIG. 4, the OCV current values in the rapidly changing point of the VCT response speed at the retard side and in the rapidly changing point of the VCT response speed at the advance side are to be learned. Therefore, use of the learning value causes the variable valve timing control (OCV current control) to be realized in consideration of the manufacturing variations of the variable valve timing adjusting mechanism 11 and the hydraulic control valve 21. In detail, when the OCV current values in the rapidly changing point of the VCT response speed at the retard side and in the rapidly changing point of the VCT response speed at the advance side are learned, it is possible to eliminate or reduce the control prohibition region in the vicinity of the rapidly changing point of each of the VCT response speeds (refer to FIG. 14). Thereby, the feedback control region or the feedforward control region can be enlarged by the corresponding amount and the control characteristic in the region of the rapidly changing point of the VCT response speed can be improved by the learning value.

It should be noted that the learning of the VCT response characteristic is not limited to the learning of the rapidly changing point of the VCT response speed, but for example, the drain switching valve 34 or 35 in either one of the advance chamber 18 and the retard chamber 19 may be opened to learn a relation between the OCV current value and the VCT response speed in a region where either one of the one-way valve 30 or 31 does not function. Alternatively, the drain switching valves 34 and 35 in both of the advance chamber 18 and the retard chamber 19 may be closed to learn a relation between the OCV current value and the VCT response speed in a region where both of the one-way valves 30 and 31 effectively function. Here, the region where either one of the one-way valve 30 or 31 does not function is a region of performing a relatively rapid advance/retard operation (in the present embodiment, this region is set to the feedforward control region). Further, the region where both of the one-way valves 30 and 31 effectively function is a region of performing a relatively gentle advance/retard operation and a region at intermediate holding (in the present embodiment, this region is set to the feedback control region). In this way, when the VCT response characteristic in the region other than the rapidly changing point of the VCT response speed is learned, the variations of the VCT response characteristic due to the manufacturing variations in the variable valve timing adjusting mechanism 11 or the hydraulic control valve 21 can be widely learned and corrected. In consequence, the control characteristic in the region other than the rapidly changing point of the VCT response speed can be improved.

In addition, in the present embodiment, the learning value of the VCT response characteristic is stored in the rewritable, involatile memory. Therefore, the stored learning value of the VCT response characteristic can be held even at engine stopping, thus providing an advantage of being capable of accurately controlling the OCV current value by using the learning value of the VCT current value immediately after the engine is next started.

Figure 22:
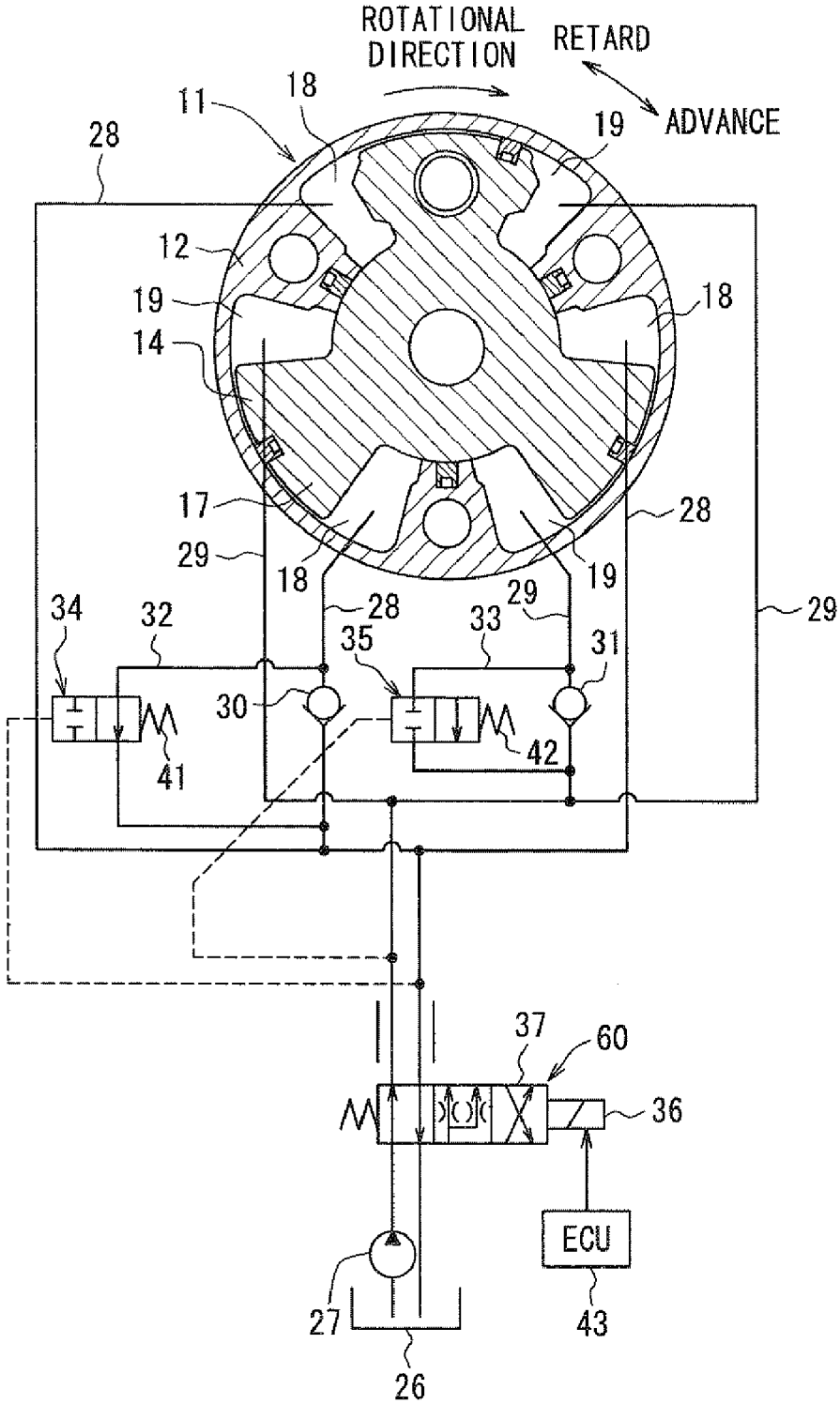
FIG. 22 is a schematic diagram showing a variable valve timing adjusting mechanism and a hydraulic control circuit thereof in another embodiment of the present invention.

It should be noted that in the present embodiment, the present invention is applied to the variable valve timing adjusting mechanism shown in FIG. 1, but is not limited to this and for example, may be also applied to a variable valve timing adjusting mechanism shown in FIG. 22.

The variable valve timing adjusting mechanism shown in FIG. 22 differs in the following respect form that of FIG. 1. It should be noted that components in FIG. 22 identical to those in FIG. 1 are referred to as identical numerals.

The variable valve timing adjusting mechanism shown in FIG. 1 is structured to be provided with two valves composed of the valve of switching the oil passages for the advance/retard hydraulic control function and the valve of switching the oil passages for the drain switching control function. On the other hand, the variable valve timing adjusting mechanism shown in FIG. 22 is structured in such a manner as to carry out the advance/retard hydraulic control function and the drain switching control function by a single valve. In addition, therefore, it is structured in such a manner that the hydraulic supply passages 28 and 29 are branched between the hydraulic control valve and the one-way valve and are respectively communicated with the drain switching valves 34 and 35.

In addition, in FIG. 1, the one-way valve and the drain switching valve are disposed in the hydraulic pressure supply passages corresponding to the advance chamber and the retard chamber in the single vane-accommodating chamber defined by a single vane, but in FIG. 22, the one-way valve and the drain switching valve are disposed in the hydraulic pressure supply passage corresponding to the advance chamber in one vane-accommodating chamber and also in the hydraulic pressure supply passage corresponding to the retard chamber in the other vane-accommodating chamber.

In addition, the drain switching valves 34 and 35 may be normally closed-type switching valves, which are held in a closed position by springs 41 and 42 when the hydraulic pressure is not applied thereto. In this case, the drain switching control valve 38 is structured to supply the hydraulic pressure at the time of closing the drain switching valve in FIG. 1, but may be structured to stop the hydraulic pressure supply at the time of closing the drain valve.

What is claimed is:

1. A controller for a vane-type variable valve timing adjusting mechanism in which each of a plurality of vane accommodating chambers formed in a housing is divided into an advance hydraulic chamber and a retard hydraulic chamber by a vane, a one-way valve is disposed in each of a hydraulic supply passage of the advance hydraulic chamber and a hydraulic supply passage of the retard hydraulic chamber in at least one of the vane accommodating chambers for preventing reverse flow of operating oil from the each hydraulic chamber, a drain oil passage is disposed in parallel to the hydraulic supply passage of the each hydraulic chamber for bypassing the one-way valve and a hydraulic control valve for controlling a hydraulic pressure supplied to the each hydraulic chamber includes integrally a drain switching control function for opening/closing the drain oil passage of the each hydraulic chamber, wherein:

response characteristic learning means is provided for learning a response characteristic of the variable valve timing adjusting mechanism to a control current value of the hydraulic control valve.

2. A controller for a vane-type variable valve timing adjusting mechanism according to claim 1, wherein:

the response characteristic learning means learns a control current value with which a response speed of the variable valve timing adjusting mechanism rapidly changes by switching the opening/closing of the drain oil passage, as the response characteristic of the variable valve timing adjusting mechanism.

3. A controller for a vane-type variable valve timing adjusting mechanism according to claim 1, wherein:

the response characteristic learning means learns a relation between the control current value of the hydraulic control valve and the response speed of the variable valve timing adjusting mechanism in a region where the drain oil passage in one of the advance hydraulic chamber and the retard hydraulic chamber is opened and one of the one-way valves does not function, as the response characteristic of the variable valve timing adjusting mechanism.

4. A controller for a vane-type variable valve timing adjusting mechanism according to claim 1, wherein:

the response characteristic learning means learns a relation between the control current value of the hydraulic control valve and the response speed of the variable valve timing adjusting mechanism in a region where the drain oil passages in both of the advance hydraulic chamber and the retard hydraulic chamber are closed and both the one-way valves effectively function, as the response characteristic of the variable valve timing adjusting mechanism.

5. A controller for a vane-type variable valve timing adjusting mechanism according to claim 1, further comprising:

holding current value learning means for learning a control current value of the hydraulic control valve at the time of holding an actual displacement angle of the variable valve timing adjusting mechanism to a target displacement angle as a holding current value, wherein:

the response characteristic learning means learns a response characteristic of the variable valve timing adjusting mechanism to a deviation between the holding current value learned by the holding current value learning means and the control current value of the hydraulic control valve, at the time of learning the response characteristic of the variable valve timing adjusting mechanism.

6. A controller for a vane-type variable valve timing adjusting mechanism according to claim 1, wherein:

the response characteristic learning means learns a response characteristic of the variable valve timing adjusting mechanism in an operating region where a target displacement angle at normal controlling is advanced to more than a predetermined value.

7. A controller for a vane-type variable valve timing adjusting mechanism according to claim 1, wherein:

the response characteristic learning means sets a target displacement angle at the time of learning the response characteristic of the variable valve timing adjusting mechanism to approximately a half of the target displacement angle at normal controlling.

8. A controller for a vane-type variable valve timing adjusting mechanism according to claim 1, wherein:

the response characteristic learning means learns a response characteristic of the variable valve timing adjusting mechanism in an operating region where a change of engine torque to a change of an actual displacement angle of the variable valve timing adjusting mechanism is small.

9. A controller for a vane-type variable valve timing adjusting mechanism according to claim 1, further comprising:

a rewritable involatile memory for storing a learning value of the response characteristic of the variable valve timing adjusting mechanism learned by the response characteristic learning means; and current control means for correcting the control current value of the hydraulic control valve by using the learning value of the response characteristic stored in the involatile memory during engine operating.

10. A controller for a vane-type variable valve timing adjusting mechanism according to claim 1, further comprising:

a drain switching valve disposed in the each drain oil passage and driven by a hydraulic pressure, wherein:

the each drain oil passage is opened/closed by opening/closing the each drain switching valve by hydraulic control of the drain switching control function of the hydraulic control valve.

11. A controller for a vane-type variable valve timing adjusting mechanism in which each of a plurality of vane accommodating chambers formed in a housing is divided into an advance hydraulic chamber and a retard hydraulic chamber by a vane, the controller comprising:

a first one-way valve disposed in a hydraulic supply passage of the advance hydraulic chamber in at least one of the vane accommodating chambers for preventing reverse flow of operating oil from the advance hydraulic chamber;

a first drain oil passage bypassing the first one-way valve;

a second one-way valve disposed in a hydraulic supply passage of the retard hydraulic chamber in at least one of the vane accommodating chambers for preventing reverse flow of operating oil from the retard hydraulic chamber;

a second drain oil passage bypassing the second one-way valve; and a hydraulic control valve for controlling the hydraulic pressure supplied to the variable valve timing adjusting mechanism, wherein:

the hydraulic control valve includes integrally a drain switching control function for opening/closing the first and second drain oil passages, further comprising:

response characteristic learning means for learning a response characteristic of the variable valve timing adjusting mechanism to a control current value of the hydraulic control valve.

12. A controller for a vane-type variable valve timing adjusting mechanism according to claim 11, wherein:

the response characteristic learning means learns a control current value with which a response speed of the variable valve timing adjusting mechanism rapidly changes by switching the opening/closing of the drain oil passage, as the response characteristic of the variable valve timing adjusting mechanism.

13. A controller for a vane-type variable valve timing adjusting mechanism according to claim 11, wherein:

the response characteristic learning means learns a relation between the control current value of the hydraulic control valve and the response speed of the variable valve timing adjusting mechanism in a region where the drain oil passage in one of the advance hydraulic chamber and the retard hydraulic chamber is opened and one of the one-way valves does not function, as the response characteristic of the variable valve timing adjusting mechanism.

14. A controller for a vane-type variable valve timing adjusting mechanism according to claim 11, wherein:

the response characteristic learning means learns a relation between the control current value of the hydraulic control valve and the response speed of the variable valve timing adjusting mechanism in a region where the drain oil passages in both of the advance hydraulic chamber and the retard hydraulic chamber are closed and both the one-way valves effectively function, as the response characteristic of the variable valve timing adjusting mechanism.

15. A controller for a vane-type variable valve timing adjusting mechanism according to claim 11, further comprising:

holding current value learning means for learning a control current value of the hydraulic control valve at the time of holding an actual displacement angle of the variable valve timing adjusting mechanism to a target displacement angle as a holding current value, wherein:

the response characteristic learning means learns a response characteristic of the variable valve timing adjusting mechanism to a deviation between the holding current value learned by the holding current value learning means and the control current value of the hydraulic control valve at the time of learning the response characteristic of the variable valve timing adjusting mechanism.

16. A controller for a vane-type variable valve timing adjusting mechanism according to claim 11, wherein:

the response characteristic learning means learns a response characteristic of the variable valve timing adjusting mechanism in an operating region where a target displacement angle at normal controlling is advanced to more than a predetermined value.

17. A controller for a vane-type variable valve timing adjusting mechanism according to claim 11, wherein:

the response characteristic learning means sets a target displacement angle at the time of learning the response characteristic of the variable valve timing adjusting mechanism to approximately a half of the target displacement angle at normal controlling.

18. A controller for a vane-type variable valve timing adjusting mechanism according to claim 11, wherein:

the response characteristic learning means learns a response characteristic of the variable valve timing adjusting mechanism in an operating region where a change of engine torque to a change of an actual displacement angle of the variable valve timing adjusting mechanism is small.

19. A controller for a vane-type variable valve timing adjusting mechanism according to claim 11, further comprising:

a rewritable, involatile memory for storing a learning value of the response characteristic of the variable valve timing adjusting mechanism learned by the response characteristic learning means; and current control means for correcting the control current value of the hydraulic control valve by using the learning value of the response characteristic stored in the involatile memory during engine operating.

20. A controller for a vane-type variable valve timing adjusting mechanism according to claim 11, further comprising:

a first drain control valve disposed in the first drain oil passage and driven by a hydraulic pressure; and a second drain control valve disposed in the second drain oil passage and driven by a hydraulic pressure, wherein:

the first drain oil passage is opened/closed by opening/closing the first drain control valve and the second drain oil passage is opened/closed by opening/closing the second drain control valve by hydraulic control of the drain oil passage control function of the hydraulic control valve by hydraulic control of the drain oil passage control function of the hydraulic control valve.

21. A controller for a vane-type variable valve timing adjusting mechanism in which each of a plurality of vane accommodating chambers formed in a housing is divided into an advance hydraulic chamber and a retard hydraulic chamber by a vane, the controller comprising:

a first one-way valve disposed in a hydraulic supply passage of the advance hydraulic chamber in at least one of the vane accommodating chambers for preventing reverse flow of operating oil from the advance hydraulic chamber;

a first drain control valve disposed in a first drain oil passage bypassing the first one-way valve and driven by a hydraulic pressure;

a second one-way valve disposed in a hydraulic supply passage of the retard hydraulic chamber in at least one of the vane accommodating chambers for preventing reverse flow of operating oil from the retard hydraulic chamber a second drain control valve disposed in a second drain oil passage bypassing the second one-way valve and driven by the hydraulic pressure;

a first hydraulic control valve for controlling the hydraulic pressure supplied to the variable valve timing adjusting mechanism; and a second hydraulic control valve for controlling the hydraulic pressure driving the first and second drain control valves, wherein:

a shaft of the first hydraulic control valve is integral with a shaft of the second hydraulic control valve, further comprising:

response characteristic learning means for learning a response characteristic of the variable valve timing adjusting mechanism to a control current value for controlling the first and second hydraulic control valves.

22. A controller for a vane-type variable valve timing adjusting mechanism according to claim 21, wherein:

the response characteristic learning means learns a control current value with which a response speed of the variable valve timing adjusting mechanism rapidly changes by switching the opening/closing of the first drain oil passage and the second drain oil passage, as the response characteristic of the variable valve timing adjusting mechanism.

23. A controller for a vane-type variable valve timing adjusting mechanism according to claim 21, wherein:

the response characteristic learning means learns a relation between the control current value and the response speed of the variable valve timing adjusting mechanism in a region where the drain oil passage in one of the advance hydraulic chamber and the retard hydraulic chamber is opened and one of the one-way valves does not function, as the response characteristic of the variable valve timing adjusting mechanism.

24. A controller for a vane-type variable valve timing adjusting mechanism according to claim 21, wherein:

the response characteristic learning means learns a relation between the control current value for controlling the first and second hydraulic control valves and the response speed of the variable valve timing adjusting mechanism in a region where the drain oil passages in both of the advance hydraulic chamber and the retard hydraulic chamber are closed and both the one-way valves effectively function, as the response characteristic of the variable valve timing adjusting mechanism.

25. A controller for a vane-type variable valve timing adjusting mechanism according to claim 21, further comprising:

holding current value learning means for learning a control current value for controlling the first and second hydraulic control valves at the time of holding an actual displacement angle of the variable valve timing adjusting mechanism to a target displacement angle, as a holding current value, wherein:

the response characteristic learning means learns a response characteristic of the variable valve timing adjusting mechanism to a deviation between the holding current value learned by the holding current value learning means and the control current value at the time of learning the response characteristic of the variable valve timing adjusting mechanism.

26. A controller for a vane-type variable valve timing adjusting mechanism according to claim 21, wherein:

the response characteristic learning means learns a response characteristic of the variable valve timing adjusting mechanism in an operating region where a target displacement angle at normal controlling is advanced to more than a predetermined value.

27. A controller for a vane-type variable valve timing adjusting mechanism according to claim 21, wherein:

the response characteristic learning means sets a target displacement angle at the time of learning the response characteristic of the variable valve timing adjusting mechanism to approximately a half of the target displacement angle at normal controlling.

28. A controller for a vane-type variable valve timing adjusting mechanism according to claim 21, wherein:

the response characteristic learning means learns a response characteristic of the variable valve timing adjusting mechanism in an operating region where a change of engine torque to a change of an actual displacement angle of the variable valve timing adjusting mechanism is small.

29. A controller for a vane-type variable valve timing adjusting mechanism according to claim 21, further comprising:

a rewritable, involatile memory for storing a learning value of the response characteristic of the variable valve timing adjusting mechanism learned by the response characteristic learning means; and current control means for correcting the control current value for controlling the first and second hydraulic control valves by using the learning value of the response characteristic stored in the involatile memory during engine operating.

* * * * *